United States Patent [19]

Suzuki et al.

[11] Patent Number: 4,725,843

[45] Date of Patent: Feb. 16, 1988

[54] ATTITUDE CONTROL SYSTEM FOR ANTENNA ON MOBILE BODY

[75] Inventors: Katsuo Suzuki, Nagoya; Takahiro Yamada, Tokyo, both of Japan

[73] Assignee: Aisin Seiki Kabushikikaisha, Japan

[21] Appl. No.: 845,315

[22] Filed: Mar. 28, 1986

[30] Foreign Application Priority Data

Mar. 29, 1985 [JP] Japan ..... 60-66128

[51] Int. Cl.[4] ..... H01Q 1/32; H01Q 3/08

[52] U.S. Cl. ..... 342/359; 343/714; 318/649; 364/434

[58] Field of Search ..... 342/50, 70, 75, 352, 342/357, 359, 422, 428, 429; 343/711, 713, 714, 757; 318/649; 364/424, 426, 434, 431.07, 453, 460, 516

[56] References Cited

U.S. PATENT DOCUMENTS 3,947,807 3/1976 Tyler et al. ..... 342/50 X
4,035,805 7/1977 Mobley ..... 318/649 X
4,630,056 12/1986 Noguchi et al. ..... 342/359 X

FOREIGN PATENT DOCUMENTS 0161429 9/1983 Japan ..... 343/714

*Primary Examiner*—Theodore M. Blum
*Assistant Examiner*—Gilberto Barrón, Jr.
*Attorney, Agent, or Firm*—Sughrue, Mion, Zinn, Macpeak, and Seas

[57] ABSTRACT

The location of a vehicle itself is detected on the vehicle in combination with an attitude control of an antenna mounted on the vehicle so that the antenna is directed toward a geostationary satellite. The antenna is driven for rotation about both a horizontal and a vertical shaft. A mean running speed MVb and a mean azimuth MQd of the vehicle over a time interval $t_2$ are used to calculate corrections ΔPx and ΔPy to the vehicle location, which corrections are added to vehicle location data corresponding to the starting point of the interval $t_2$. A mean azimuth MQd, a mean speed MVb, a mean roll angle MQr and a mean pitch angle MQp are used to control shifts ΔQdpo and ΔQppo which occur in the antenna attitude relative to the geostationary satellite as a result of the running of the vehicle over the time interval $t_2$, and these shifts are used to correct the antenna attitude. In order to allow the antenna to be maintained as directed toward the geostationary satellite if the vehicle rapidly changes its direction of travel, the antenna attitude is controlled in advance in accordance with rates of change in running speed Vb, throttle opening Op, angle of rotation of steering wheel Sa, roll angle Qr and pitch angle Qd of the vehicle, by detecting these rates of change.

11 Claims, 20 Drawing Figures

Qppo correction 1R
58
Qppo - RT1N → Qppo
165
0 → RT1ΔQppo
0 → RT1N
166
return

Qppo correction 1S
57
Qppo = f1(RAVb)
156
RT1ΔQppo + Qppo → RT1ΔQppo
157
RT1ΔQppo ≧ 0 ?
158
YES
NO
RT1ΔQppo - RT1N ≧ 1 ?
159
YES
NO
Qppo + 1 → Qppo
160
RT1N + 1 → RT1N
161
RT1ΔQppo - RT1N ≦ 1 ?
162
YES
NO
Qppo - 1 → Qppo
163
RT1N - 1 → RT1N
164
return

ATTITUDE CONTROL SYSTEM FOR ANTENNA ON MOBILE BODY

FIELD OF THE INVENTION

The invention relates to an attitude control of an antenna on mobile body, and in particular, while not intended to be limited thereto, to the attitude control of an antenna on a vehicle so that the antenna is maintained in opposing relationship with a stationary object which transmits, relays or reflects a radio wave.

BACKGROUND OF THE INVENTION

In the communication between mobile stations, in receiving television broadcasts or radio wave on an ordinary vehicle, or in the recognition of its own position on a vechile, marine vessel or aircraft (hereinafter collectively referred to as vehicle), an antenna with an associated antenna attitude control system is mounted on such vehicle in order to receive a radio wave from a land-based (including maritime) fixed station or geostationary satellite, or to transmit a radio wave toward such land-based fixed station or geostationary satellite to receive a reflection therefrom. Examples of such technique are disclosed in Japanese Laid-Open Patent Application Nos. 140,302/1980 and 89,101/1981.

The former disclosure relates to the antenna attitude control of self-tracking type. Specifically, as a marine vessel moves, the amount of a shift in the position of the marine vessel corresponding to such movement is calculated on the basis of the direction in which and the distance through which the vessel has moved. An offset in the position of the antenna relative to the fixed base station which corresponds to such shift is calculated from the amount of shift in order to alter the position of the antenna relative to the fixed base station. The amount of shift is accumulatively added to the position which the vessel assumed before the movement to determine the current position of the vessel. This technique has both the mobile communication (relay of a television broadcast) and the recognition of the position of a mobile body for its objects.

The latter disclosure relates to the antenna attitude control of so-called programmed tracking type. Specifically, for a vehicle which travels along a given route, the positions of the antenna at various points along the route which provide an optimum reception relative to a particular fixed station are previously stored, and a distance from an origin which has been travelled by the vehicle is used to an access a memory to read a corresponding position of the antenna, thus altering the position of the antenna.

Problems experienced with the antenna attitude control of either self-tracking or programmed tracking type mentioned above are how to enable a correction to be effected in the antenna position so as to track a rapid movement of the mobile body and how to reduce an error in the position detected, in particular, an accumulated error inasmuch as the location of the movable body represents a principal parameter when establishing the position of the antenna. Depending on the manner of movement of the mobile body, the antenna may face away from a target station, causing a reduction in the reception level or inability of reception. Such tendency is pronounced for a rapid removing mobile body of a small size. For example, considering an automobile, the position of the vehicle or more exactly the position of the antenna may change in various manners depending on the road conditions or the running conditions even though the automobile runs on the same road. Where a high directivity antenna is used, the reception may be interrupted during the running depending on the running condition even though the line of sight is maintained.

SUMMARY OF THE INVENTION

The invention has for its first object to enable a correction to be made in the antenna position so as to track a rapid movement of a mobile body even when the body moves relatively rapidly; has for its second object to cause an antenna mounted on a mobile body to be directed toward a fixed target station in a stabilized manner even though the mobile body experiences a relatively rapid change in the position; has for its third object a reduction of an offset in the antenna position which is attributable to an accumulated error in the detection of the position; and has its fourth object the assessment of an accurate position of a movable body through an accurate tracking of the antenna with respect to a fixed target station.

The above objects are accomplished in accordance with the invention by providing, an improvement in an antenna position set-up mechanism including a first drive mechanism for driving an antenna for rotation about a horizontal shaft on a mobile body, first energization means for energizing the first drive mechanism in accordance with first position information to establish the antenna at an angle of rotation which is specified by the first position information, a second drive mechanism for driving the antenna for rotation about a vertical shaft on the mobile body, and second energization means for energizing the second drive mechanism in accordance with second position information to establish the antenna at an angle of rotation specified by the second attitude control; the improvement comprising means for detecting a distance travelled by the mobile body, means for detecting the attitude of the mobile body, means for detecting a rate of change in the attitude of the mobile body, and attitude control means for supplying the first and the second position information to the first and the second energization means, respectively, and for modifying the first and the second position information in accordance with the distance travelled, the attitude and the rate of change which are detected.

This arrangement allows not only a correction in the attitude of the antenna in accordance with the attitude and travelled distance of the mobile body, but also predicts a change in the attitude of the movable body, thus allowing the antenna attitude to be corrected in anticipation of a change in the attitude of the mobile body thus in a so-called predictive manner. This achieves a rapid control over the antenna attitude, which tracks a rapid movement of the mobile body. This arrangement is particularly effective when the movable body rapidly changes its attitude.

Means for detecting the attitude may comprise a gyroscope for detecting the direction in which the mobile body travels, a first inclination sensor which detects an angle of inclination (pitch angle) of the mobile body with respect to a horizontal plane as viewed in the direction of travel and/or a second inclination sensor which detects an angle of inclination (roll angle) of the mobile body with respect to the horizontal plane as viewed in a direction orthogonal to the direction of travel. When all of these components are provided, the attitude of the antenna can be corrected in accordance with the direction of travel, the pitch angle and the roll angle, achieving a higher precision of tracking for the antenna.

Means for detecting a rate of change may comprise differentiator means which detects the rate of a change in a signal which may represent the direction of travel as obtained from the gyroscope, the pitch angle obtained from the first inclination sensor or the roll angle obtained from the second inclination sensor. Where the mobile body comprises a vehicle, the means for detecting a rate of change preferably further comprises means for detecting a rate of change in a throttle opening, means for detecting a rate of change in the angle of rotation of a steering wheel, means for detecting a rate of change in the depression of a brake and/or means for detecting an acceleration (including deceleration) of the vehicle. Where the mobile body comprises a vehicle which is provided with all of the means mentioned above, the antenna attitude can be corrected in a manner which foresees a change in the attitude of the vehicle which may be caused by changes in the road condition including the inclination in the direction of travel, the inclination in a direction orthogonal to the direction of travel, and unevenness, the acceleration and deceleration of a vehicle (nose-up or nose-down of the vehicle), a change in the direction which may be a rolling of the vehicle or a change in the direction of travel and a change in a braking condition (nose down of the vehicle), thus improving the tracking capability of the antenna.

In one embodiment of the invention, the attitude control means may also be operative to calculate information relating to the position of the mobile body based on the detected attitude of the mobile body and the distance travelled, and also to calculate information relating to the position of the mobile body on the basis of the first and the second attitude information. In a preferred embodiment, the attitude control means successively modifies the first and the second attitude information in an attempt to search for such first and second attitude information which provides an increased level of reception by the antenna. The attitude of the antenna is established in a corresponding manner. The first and the second attitude information which have been searched for are used to calculate information relating to the position of the mobile body, which is then compared against the prevailing positional information. If there is a difference of an increased magnitude therebetween, the prevailing positional information is replaced by the positional information which is now calculated. Alternatively, the replacement may take place directly without comparison. This eliminates any accumulated error in the positional information which is normally maintained, allowing positional information of high accuracy to be maintained.

Other objects and features of the invention will become apparent from the following description of an embodient thereof with reference to the drawings.

DESCRIPTION OF PREFERRED EMBODIMENT

Figure 1:
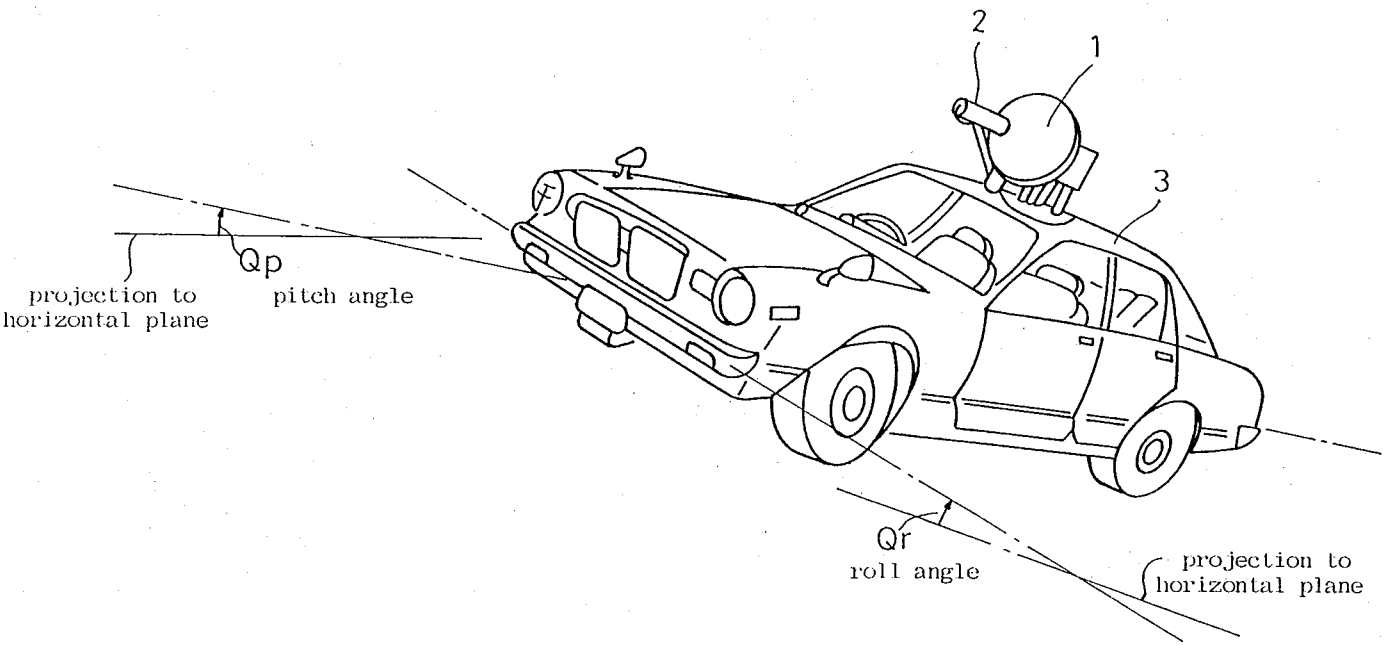
FIG. 1 is a perspective view, showing the appearance of one embodiment of the invention.

Referring to FIG. 1 which shows the appearance of one embodiment of the invention, a mobile body is illustrated as a vehicle having a roof 3 on which an antenna 1 is mounted for receiving a radio wave transmitted from a geostationary satellite and associated with a BS converter 2.

Figure 2A:
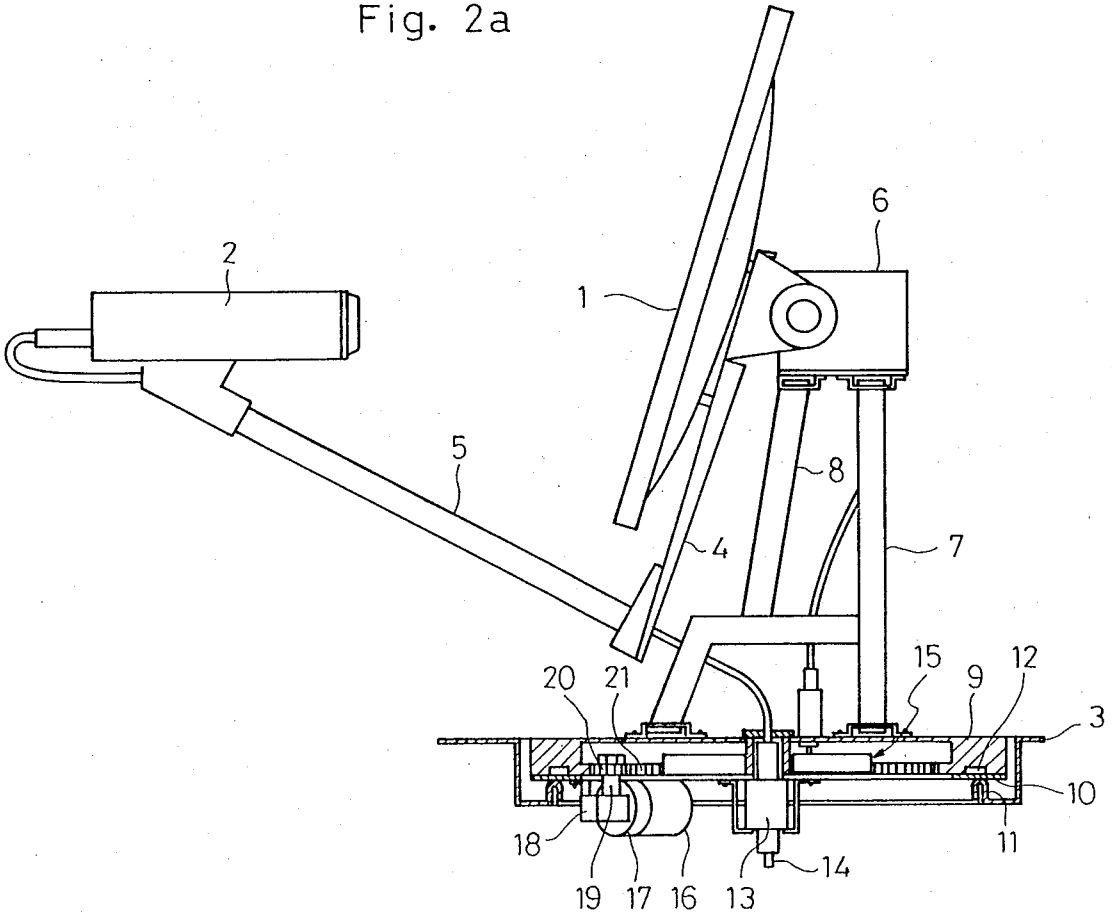
FIG. 2*a* is an enlarged side elevation, partly broken away, of a support structure for an antenna shown in FIG. 1.
Figure 2B:
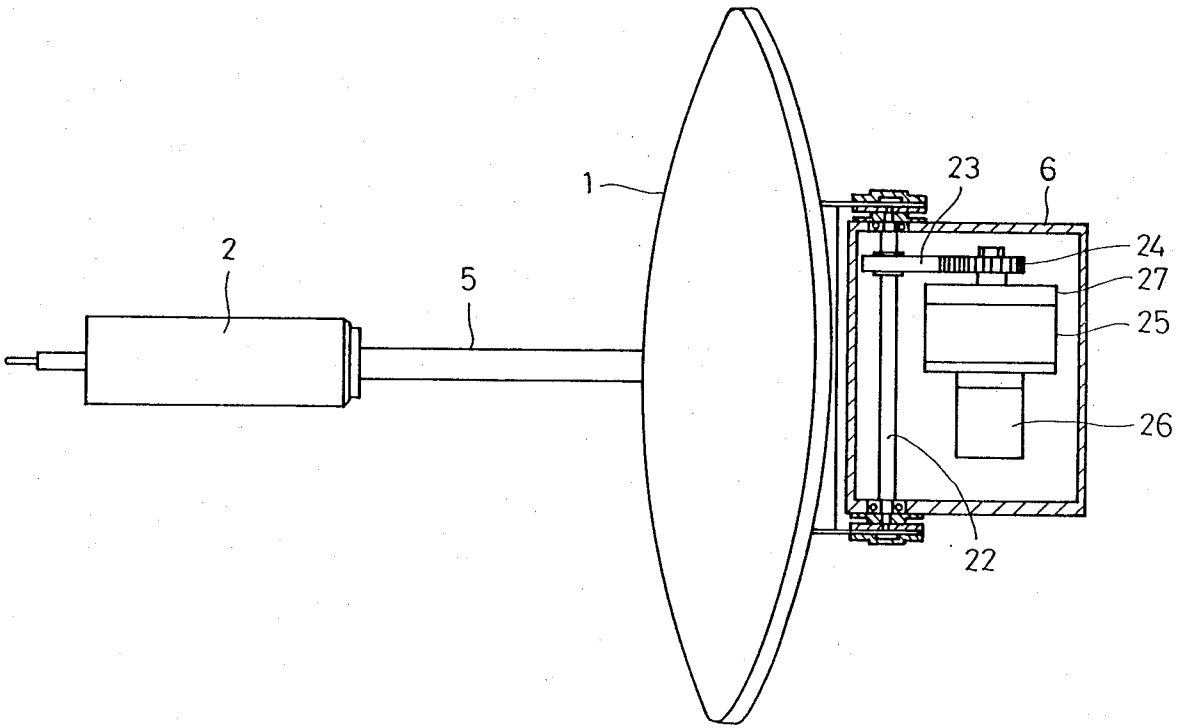
FIG. 2*b* is an enlarged plan view, partly broken away, of the antenna support structure shown in FIG. 1.

FIG. 2*a* shows a support structure for the antenna 1 and the BS converter 2. The converter 2 is carried by an arm 5 which is in turn supported by a frame 4 secured to the antenna 1. Thus the converter 2 is integrally mounted on the antenna 1.

The antenna 1 is pivotally mounted on a support box 6 which is in turn fixedly mounted on a rotatable base 9 through a pair of legs 7 and 8. The rotatable base 9 is placed on top of a stationary base 10, and carries a bearing 12 which is disposed in abutment against the stationary base 10. By means, not shown, the stationary base 10 is fixedly mounted on the vehicle. The roof 3 has a circular depression formed therein, with the bottom of the depression being open. A weather strip 11 which provides a water tightness is applied around the edge of the opening and bears against the lower surface of the stationary base 10.

Annular internal gear teeth 21 are formed around the rotatable base 10 and mesh with a gear 20 which is fixedly mounted on a shaft 19. Also fixedly mounted on the shaft 19 is a worm wheel, not shown, of a reduction gearing 18, and a worm, not shown, which meshes with the worm wheel is fixedly mounted on the rotary shaft of a motor 16. A rotary encoder 17 is coupled to the rotary shaft of the motor 16. Since the motor 16 is fixedly mounted on the stationary base 10, when the motor 16 is driven for rotation in a forward direction, the rotatable base 9 also rotates in a forward direction. Conversely, when the motor 16 is driven for rotation in a reverse direction, the rotatable base 9 also rotates in a reverse direction. The azimuth of the antenna 1 is thus established by such rotation in either forward or reverse direction.

The antenna support box 6 contains various electrical components connected to an electrical cable which is connected to a fixed cable or wires thereof through a disc-shaped slip ring unit 15. The BS converter 2 also contain various electrical components connected to an electrical cable, which is connected to a fixed cable 14 or wires thereof through a cylindrical slip ring unit 13.

FIG. *2b* shows the internal construction of the antenna support box 6. A rotary shaft 22 is fixedly connected to the antenna 1 and is pivotally mounted within the box 6. A sector gear 23 is fixedly mounted on the rotary shaft 22 and meshes with a gear 24 which is fixedly mounted on the output shaft of a reduction gearing 25. The output shaft is also coupled to a potentiometer 27. The reduction gearing 25 has an input shaft which is connected to the rotary shaft of a motor 26. When the motor 26 rotates in a forward direction, the shaft 22 also rotates in a forward direction, and conversely when the motor 26 rotates in a reverse direction, the shaft 22 also rotates in a reverse direction. The elevation angle of the antenna 1 is established by such rotation of the motor 26 in either forward or reverse direction. The elevation angle of the antenna is indicated by an analog signal which is delivered by the potentiometer 27.

FIG. *3a* shows an operating board 33 which is located within the vehicle. As shown, the board 33 includes numerical keys $30_0$ to $30_9$, a clear key 30*c*, an operation mode command keys 30*fa*, 30*sa*, 30*m*, a key 30*e* which specifies an entry made in terms of the numerical keys as indicating an elevation angle or an azimuth of the antenna, a set key 30*s* which instructs an elevation angle or an azimuth as indicated by the entry by the numerical keys to be established with the antenna, an elevation angle up key 30*b* which causes the elevation angle of the antenna to be incremented by one step or minimum unit, an elevation angle down key 30*f* which instructs the elevation angle to be decremented, an azimuth up command key $30_L$ which causes the azimuth of the antenna to be incremented by one step and an azimuth down command key $30_R$ which causes the azimuth to be decremented by one step. All of these keys represent key switches. In addition, the board 33 include a thin CRT display 32 of a reduced size as well as indicator lamps 31*fa*, 31*sa*, 31*m* and 31*e*.

FIGS. *3b* and *3c* show an electrical control system which is connected to the antenna attitude step-up mechanism (shown in FIGS. *2a* and *2b*) and the operating board 33. It is to be understood that FIGS. *3b* and *3c* are to be joined at points IIIB and IIIC to constitute together a single drawing which illustrates the entire control system. Initially referring to FIG. *3c*, there is shown a motor driver 36 which represents a servo controlled system which establishes the elevation angle of the antenna 1 so as to be equal to an angle specified by elevation angle information Qppo which is supplied from a microprocessor 66. The elevation angle information Qppo represents a target value of the elevation angle for the antenna, and the driver 36 operates to compare an analog version of the elevation angle information Qppo as derived by D/A converter 37D against an analog angle feedback signal which is actually detected by the potentiometer 27, and to energize the motor 26 for rotation so that a coincidence is reached therebetween. The potentiometer 27 provides an output signal representing the actual elevation angle Qpp of the antenna 1, which is amplified by the motor driver 36 and then applied to A/D converter 37A, whereby it is converted into digital data Qpp to be fed to the microprocessor 66.

A motor driver 38 is a servo controlled system which establishes the azimuth of the antenna 1 so as to be equal to an angle specified by azimuth information Qdpo, a target value of the azimuth, which is supplied by the microprocessor 66. The driver 38 operates to compare an analog version of azimuth information Qdpo, as derived by D/A converter 39D against the analog version of a count of pulses developed by the rotary encoder 17, which represents an actual or feedback value of the azimuth Qdp, and to energize the motor 16 for rotation so that a coincidence is reached therebetween.

While the specific arrangement is not shown, the azimuth of the antenna is determined on the basis of a count of pulses developed by the rotary encoder 17. At this end, there is provided a home position sensor which detects when the rotatable base 9 is at its home position. The motor driver 38 includes a non-volatile memory NRAM, part of which is allocated as a count register. The count register is cleared at the home position of the rotatable base 9, and is incremented by a pulse from the encoder during the rotation of the motor 16 in the forward direction. On the contrary, during the rotation of the motor 16 in the reverse direction, the count register is decremented. In this manner, the count register maintains data Qdp which represents the actual azimuth of the antenna. NRAM of the motor driver 38 is connected to a battery backup circuit which is fed from a storage battery 81 so that this memory is capable of maintaining the actual azimuth data Qdp in the event the battery 28 which represents the main power supply of the vehicle fails. The azimuth data Qdp is fed to the microprocessor 66.

The keys 30, indicator lamps 31, CRT display 32, key encoder 34 and an interface 35 shown in FIGS. *3b* and *3c* are those located on or within the operating board 33 shown in FIG. *3a*.

The BS converter 2 is connected to a BS tuner 41 and a BS level detector 44 through a distributor 40. The reception level of the BS converter 2 is detected by the level detector 44 through the distributor 40, and the microprocessor 66 instructs A/D converter 45 to effect a conversion of such level into a digital version in the form of digital BS level data BSL. The tuner 41 is connected to a television receiver 42 and a radio set 43 which are adapted to receive a satellite broadcast. In the embodiment shown, only the reception is performed, but where a transmission is involved or both transmission and reception are involved, a transmitter may also be provided.

A speed sensor 46 comprises a pulse generator which is coupled to a cable extending from a vehicle speedmeter to develop one pulse per given angle of rotation thereof. The pulse generated is fed to a signal processor 47 which essentially comprises an F/V converter, which then delivers a voltage representing the speed of the vehicle. The A/D converter 48 converts this voltage into a digital version in the form of vehicle speed data Vb, which is then fed to the microprocessor 66.

A throttle opening sensor 49 is connected to a throttle valve of an engine mounted on the vehicle and comprises a potentiometer which develops an analog voltage representing a throttle opening. The analog signal is amplified and otherwise processed within the signal processor 50 and then fed to A/D converter 51, which delivers throttle opening data Op.

A steering wheel angle of rotation sensor 52 is coupled to a steering shaft and comprises a potentiometer, which develops an analog signal representing an angle of rotation of the steering wheel Sa which is referenced to a neutral point. The signal is amplified and otherwise processed within a signal processor 53 to be supplied to A/D converter 54, which then delivers an output in the form of a steering wheel angle of rotation data Sa.

A brake depression sensor 55 is coupled to a shaft to which a brake pedal is secured and also comprises a potentiometer, which develops an analog signal representing a brake depression Bs as referenced to a brake release point. The analog signal is amplified and otherwise processed within a signal processor 56 and then fed to A/D converter 57, which delivers an output in the form of brake depression data Bs.

A pitch angle sensor 59, a roll angle sensor 61 and an azimuth detecting gyroscope 63 are mounted on a car body which moves up and down vertically in a manner independent from an axle through a shock absorber.

The patch angle as termed herein refers to an angle Qp shown in FIG. 1 which represents an angle of inclination of a car body as viewed in the direction of travel. The roll angle refers to an angle Qr shown in FIG. 1 which represents an angle of inclination of a car body in a direction orthogonal to the direction of travel. The azimuth refers to a direction of movement of a car body in a horizontal plane with respect to the horizontal axis of the gyroscope. Each of the pitch angle sensor 59 and the roll angle sensor 61 comprises a digital angle sensor including an arcuate transparent tube containing an opaque ball, the position of which is detected externally of the tube. The transparent tube has its axis set up parallel to the fore-and-aft direction of the vehicle for the pitch angle sensor 59 while the axis of the transparent tube is set up in a lateral direction of the vehicle for the roll angle sensor 61. The detected angles Qp and Qr in the digital form which are delivered from the pitch angle sensor 59 and the roll angle sensor 61 are applied to respective signal processors 60 and 62, respectively, where their waveforms are shaped before they are fed to the microprocessor 66.

The gyroscope 63 is excited by a driver 64, and develops an analog signal or azimuth Qd signal which represents an angle by which the direction of travel of the vehicle in the horizontal plane is offset from the horizontal axis of the gyroscope 63 which rotates at a high speed. This signal is converted into a digital version Qd by means of A/D converter 65 and is then fed to the microprocessor 66.

An electrical control system comprises the microprocessor 66, ROM 67, RAM 68, non-volatile RAM (NRAM) 69, a counter 70, a battery back-up circuit 71, the storage battery 81 and a constant voltage supply 82.

Figure 3A:
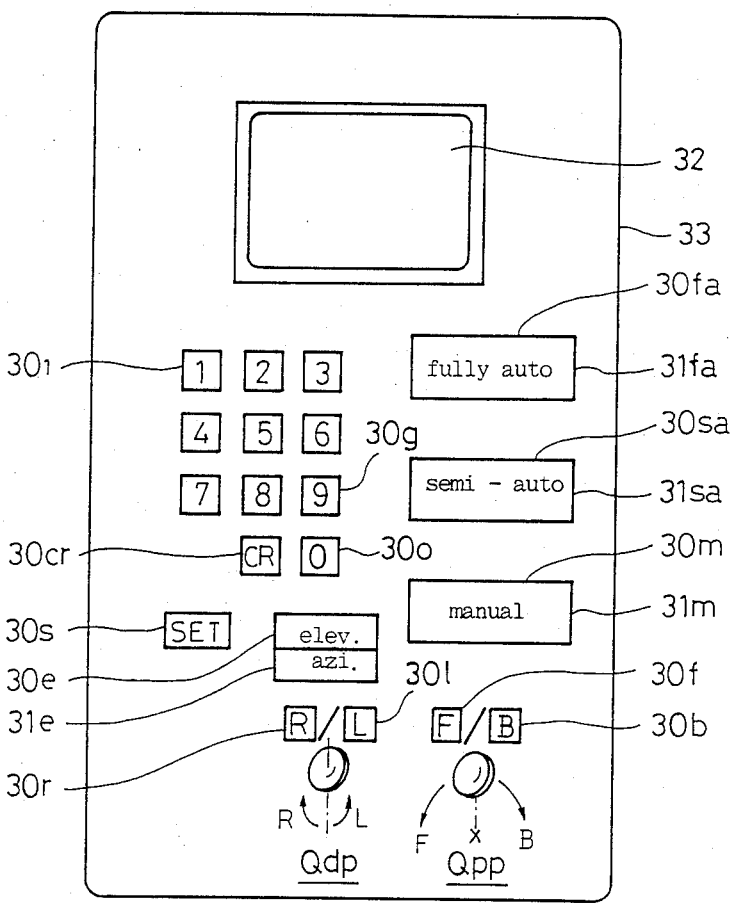
FIG. 3*a* is a plan view of an operating board which is used to command a attitude control of the antenna.
Figure 3B:
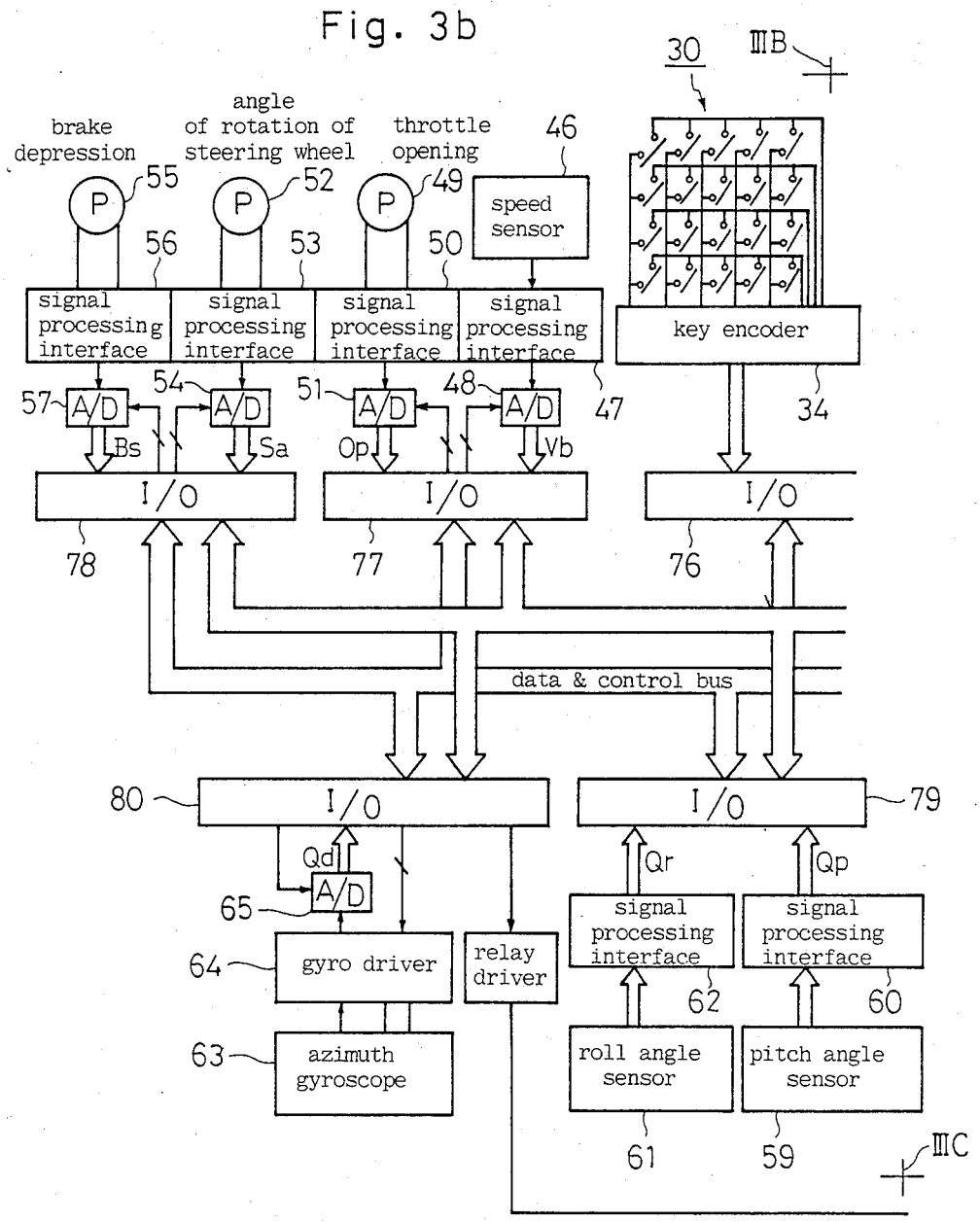
FIGS. 3*b* and 3*c* are block diagrams of a control system including the antenna and the operating board.
Figure 3C:
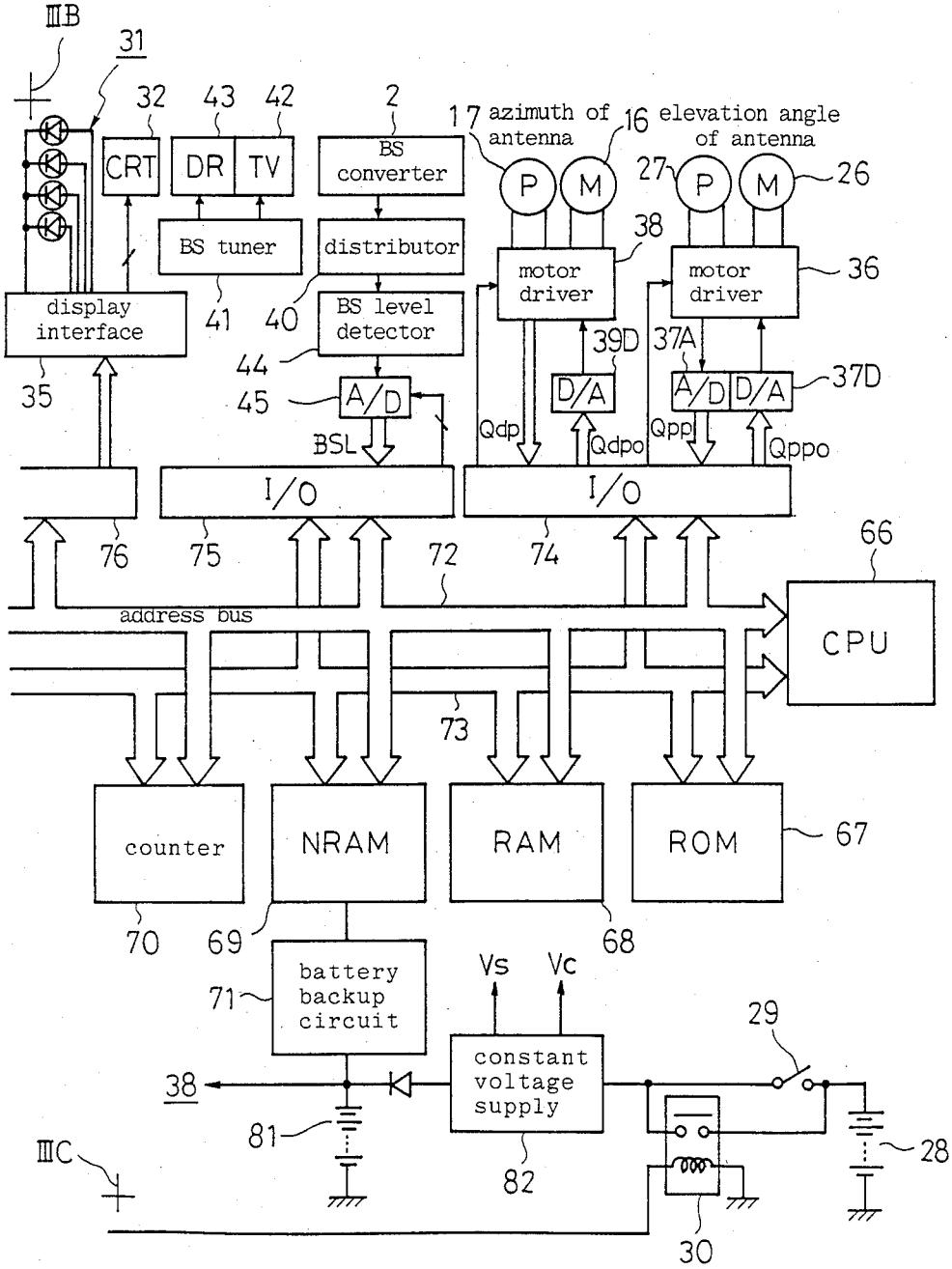

When an engine key is inserted to close the engine key switch 29, the battery 28 which represents the main power supply on the vehicle feeds the constant voltage supply 82, whereupon the power supply 71 produces voltages which are required in various parts of the control system shown in FIGS. 3*b* and 3*c*. In this embodiment, required data is retained in the NRAM during the time the vehicle is at rest or when the engine key switch 29 is off. In order to update the NRAM by final data which prevails when the engine key switch 29 is turned off, it is necessary to provide some power supply after the switch 29 is turned off. At this end, a relay 30 is connected between the battery 28 and constant voltage supply 82 so that the relay 30 can be energized in response to the switch 29 being turned on to provide a self-holding action for the power supply. When the switch 29 is turned off, the detection of the off condition causes required data to be saved in the NRAM before the relay 30 is deenergized to interrupt the application of the battery voltage to the constant power supply 82.

The described arrangement is used in combination with a control operation by the microprocessor 66 which is based on a program stored in ROM 67 in order to effect an attitude control of the antenna, which will be generally described initially.

(1) When the power supply is turned on:

When the power supply is turned on, the relay 30 is energized to provide a self-holding action for the power supply, and data which has been saved in NRAM 69 is read out, presetting the system to required conditions.

The gyroscope 63 is then excited, and when it has stabilized to a constant speed, its output data Qd is read out, and a difference between Qd and the previous azimuth data NQr which is stored in NRAM is determined as a shift in the reference axis. This represents a correcting of Qd. Specifically, the azimuth data which prevails when the power supply has been turned off is based on the location of the reference axis which obtains when the power supply has been turned on for the previous pass. However, after the power supply is turned off once, and when the power supply is turned on anew, the orientation of the reference axis is changed from its previous value, thus requiring a correcting therefor.

(2) Standby:

A key operation on the operating board 33 is then waited for. As long as no key is turned on, necessary information including the antenna elevation angle Qpp, the antenna azimuth Qdp, the antenna reception level BSL, current location (Px, Py) and the total distance travelled (the accumulated value of running distance) N2TDR are displayed on the CRT display 32.

(3) Manual set-up:

When numerical keys $30_0$ to $30_9$ are operated, a number of times the numerical keys are operated as well as a numerical figure which is represented by the key operation are loaded into a numerical register. The numerical register is cleared upon operation of the clear key 30*c*. When the manual key 30*m* is operated, the indicator lamp 31*m* is illuminated. A first operation of the key 30*e* under this condition illuminates the indicator lamp 31*e*. If the set key 30*s* is operated now, the content of the numerical register, Qppo, is delivered to and loaded into D/A converter 37D. In this manner, the antenna elevation angle Qpp is established to be equal to a value entered by the numerical keys. This represents a manual set-up of the elevation angle.

If the key 30*e* is operated when the indicator lamp 31*e* is illuminated, this lamp is extinguished. If the set key 30*s* is then operated, the content of the numerical register, which now represents Qdpo, is delivered to and loaded into D/A converter 39D. In this manner, the antenna azimuth Qdp is established to be equal to a value entered by the numerical keys. This represents a manual set-up of the azimuth.

Accordingly, a vehicle driver is capable of establishing an optimum elevation angle and azimuth for the antenna 1 at the current location of the vehicle through the entry with the numerical keys if such angles are available.

If the key switch 30*b* is turned on during the time the indicator lamp 31*m* is illuminated, the elevation data (target value) Qppo is updated incrementally at a time interval of dT as long as the switch remains on, thus stepwise increasing the elevation angle of the antenna 1. This operation ceases when the switch 30*b* is turned off. This represents a manual step-up of the elevation angle.

When the key switch 30*f* is turned on, the elevation angle data (target value) Qppo is updated decrementally at a time interval of dT as long as the switch remains on, thus reducing the elevation angle of antenna 1 stepwise. This operation ceases when the switch 30*f* is turned off. This represents a manual step-down of the elevation angle. In this manner, a vehicle driver is capable of manually establishing an optimum elevation angle and azimuth for the antenna 1 while observing BSL on the screen of the CRT display 32.

(4) Semi-automatic tracking:

When the key 30*sa* is operated, the indicator lamp 31*sa* is illuminated while the indicator lamps 31*fa* and 31*m* are extinguished. If the reception level BSL is proper at this time, the operation then proceeds to a correction of the antenna attitude in response to the running condition which will be mentioned under the paragraph (6) and to an updating of vehicle location data/a correction of the antenna attitude which will be mentioned under the paragraph (7). Thus, the operation enters an automatic mode in which an automatic tracking and automatic recognition of location are effected.

If the reception level BSL is improper when the key 30*sa* is operated, legends "error" and "requires manual adjustment or fully automatic key to be turned on" are additionally displayed on the CRT display 32, and the operation waits for either key 30*m* or 30*fa* to be operated as long as the reception level BSL remains at an improper level. If the reception level BSL turns to be proper in the course of waiting, the operation proceeds to the automatic mode (6) and (7) mentioned above. If the key 30*m* is operated when the reception level BSL is improper, the indicator lamp 31*sa* is extinguished, and the operation goes to the mode (3). If the key 30*fa* is operated when the reception level BSL is improper, the indicator lamp 31*sa* is extinguished, and the operation goes to the mode (5) which is described below.

(5) Fully automatic tracking:

When the key 30*fa* is operated, the indicator lamps 31*sa* and 31*m* are extinguished while the indicator lamp 31*fa* is illuminated. If the vehicle speed Vb and acceleration DVb are both substantially zero under this condition or if they become equal to zero subsequently, a search for optimum directivity is conducted in which the elevation angle Qpp, and if required, the azimuth Qdp of the antenna are changed stepwise to search for the optimum or maximum directivity where BSL grows to its maximum. The search for optimum directivity is subsequently repeated for a subsequent running distance equal to or greater than Dk and when both the vehicle speed Vb and acceleration DVb are substantially zero. When appropriate elevation angle Qpp and azimuth Qdp of the antenna are found during the search, the current location (Px, Py) of the vehicle is calculated on the basis of these detected values Qpp and Qdp, if the accumulated value of the running distance is equal to or greater than $D_L$ (where $D_L > D_K$) since the previous correction of the location data has been made. The calculated value is compared against the location data (NPx, NPy) which is currently retained, and if a deviation therebetween exceeds a given value (PdPx, PdPy), the currently retained location data is replaced by the calculated location data (Px, Py). This represents a correction of vehicle location data.

(6) Correction of antenna attitude responsive to running condition:

In each of the procedures mentioned under the paragraphs (1) to (5), vehicle speed Vp, throttle opening Op, angle of rotation of steering wheel Sa, brake depression Bs, pitch angle Qp, roll angle Qr and vehicle azimuth Qd are read at a brief time interval $t_1$, and a rate of change in these values is derived. The elevation angle and the azimuth of the antenna are corrected in a manner dependent on such rates of change. A high rate of change implies that there is a rapid change in the attitude of the vehicle. If the angenna attitude is corrected to follow up a rapid change in the attitude of the vehicle, it is impossible to allow the antenna attitude to faithfully follow a change in the vehicle attitude. This aspect is improved by a correction of the antenna attitude in a manner dependent on the rates of change.

When the steering wheel is not at its reference position or neutral point, the vehicle undergoes a turning movement to change its attitude if the rate of change in the angle of rotation of the steering wheel remains zero. In addition, the roll angle of the vehicle changes as a result of centrifugal force which is developed during the turning movement. Accordingly, the angle of rotation of the steering wheel is treated in the same manner as the rate of change, and the antenna attitude is corrected in a manner also dependent on the angle of rotation of the steering wheel.

It will be appreciated that these rates of change are influenced not only by the driving condition of the vehicle but also by the road conditions. Accordingly, the correction of the antenna attitude is a dynamic correction, and is clearly effective in achieving a rapid tracking capability for the antenna when such conditions experience a rapid change.

(7) Updating of vehicle location data/correction of antenna attitude:

In each of the procedures mentioned under the paragraphs (1) to (5), the vehicle speed Vp, throttle opening Op, angle of rotation of steering wheel Sa, brake depression Bs, pitch angle Qp, roll angle Qr and vehicle azimuth Qd are read at a time interval $t_2$ which is greater than the time interval $t_1$, and a mean value between a previous value and a current value is derived in association with each interval $t_2$. Using such values, a shift in the location of a vehicle and a shift in the antenna attitude during the time interval $t_2$ are calculated, thus updating the current vehicle location data and correcting the antenna attitude. In comparison to the dynamic correction mentioned previously, this constitutes what can be called a static correction, which is similar to the correction of the antenna attitude and updating of current location of a conventional automatic tracking type, as disclosed in Japanese Laid-Open Patent Application No. 140,302/1980 cited above. Because the antenna 1 exhibits a high directivity and the mobile body is a vehicle which undergoes a relatively rapid change in its attitude, there results a high tendency that the directivity axis of the antenna 1 deviates from a geostationary satellite. Accordingly, during the calculation which is made to provide a correction at substantially fixed time interval $t_2$, if the amount of correction which must be made in the antenna attitude is less than a minimum unit, a fraction less than the minumum unit is accumulated and stored so that when the accumulated value has increased beyond the minimum unit, a correction can be made by an amount corresponding to the minimum unit, with a remainder stored in an accumulation register, thus minimizing any accumulation in the error of correction.

Figure 7B:
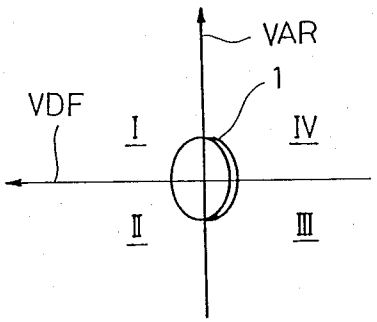
FIG. 7*b* illustrates an extent of rotation of the antenna in different quadrants.
Figure 7A:
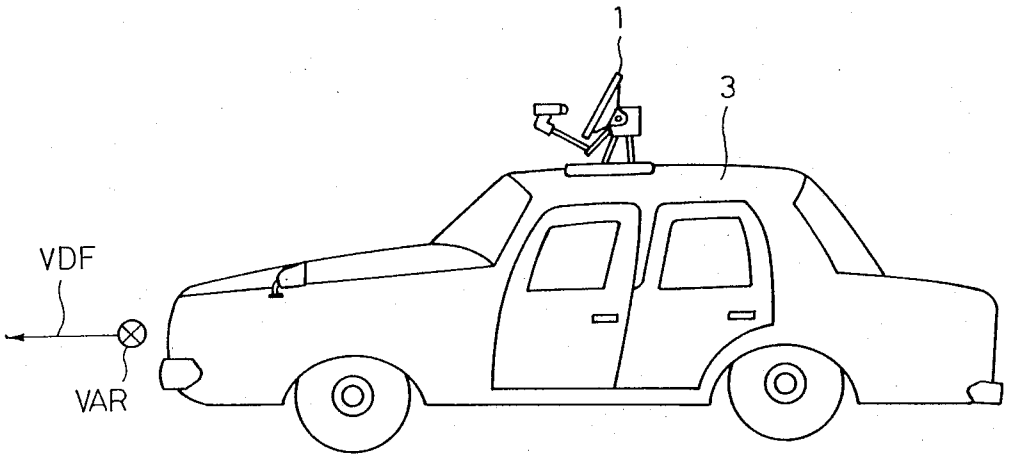
FIG. 7*a* is a side elevation of a vehicle shown in FIG. 1.

Having described the general arrangement and operation of the system, a control operation by the microprocessor 66 will now be described with reference to FIG. 4*a* and subsequent Figures. Before describing the operation, it is necessary that several assumptions used be explained initially. An origin or value zero for the elevation angle command data Qppo and actual elevation angle data Qpp of the antenna 1 is taken as the position of the antenna 1 shown in FIG. 2*a* in which it is most forwardly tilted. An original or value zero for the azimuth of the antenna 1, including both command data Qdpo and actual data Qdp, is taken as the home position of the rotatable base 9 where the BS converter 2 is located at a medium point forwardly of the vehicle. As illustrated in FIG. 7*a*, it will be appreciated that a correction to be made to the antenna attitude when the antenna 1 faces forwardly of the vehicle must be opposite from a correction to the antenna attitude when the antenna 1 faces rearwardly of the vehicle. Also, a correction to the antenna attitude when the antenna 1 is oriented to the right of the driver's seat must be opposite from the correction when the antenna is oriented to the left of the driver's seat. Thus, the correction of the antenna attitude and updating of the current location must be made in four quadrants I to IV as shown in FIG. 7*b* where VDF represents the direction of travel of the vehicle, as indicated in FIG. 7*a*. In the embodiment, the driver 36 determines a particular quadrant on the basis of the elevation angle data Qppo, and converts data Qppo to a corresponding version in the particular quadrant in order to provide a correct direction of correction. In addition, the driver 36 reads a signal from the potentiometer 27 in terms of quadrants, and converts it into a signal Qpp which is referenced to a single origin. Similarly, the driver 38 performs a similar data conversion with respect to azimuth data Qdpo and Qdp.

Figure 4A:
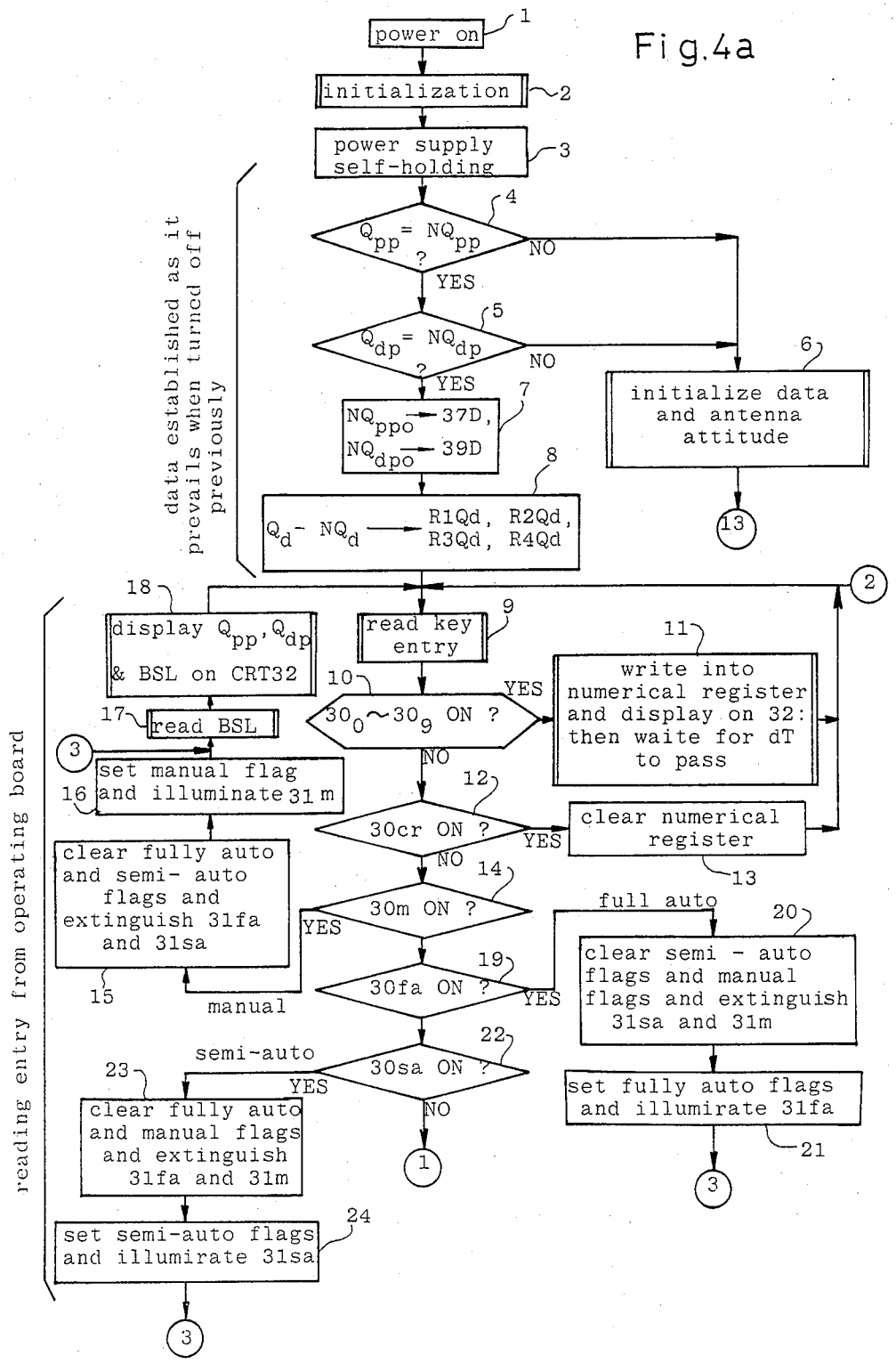
FIGS. 4*a*, 4*b*, 4*c*, 4*d*, 4*e*, 4*f*, 4*g* and 4*h* are flowcharts illustrating control operations by a microprocessor shown in FIG. 3*b*.

Referring to FIG. 4*a* initially, when the power is applied or the engine key switch 29 is turned on, the microprocessor 66 initializes input/output ports and internal and external registers to establish a standby mode (steps 1 and 2). If various parts operate normally during the standby mode, the gyroscope driver 64 is instructed to excite the gyroscope, and the program waits for the gyroscope to become stabilized at a given speed.

During the standby mode, when the gyroscope has stabilized to a constant speed, a signal which instructs the relay driver to energize is delivered, thus energizing the relay 30 to provide a self-holding action for the power supply (step 3). The elevation angle Qpp and azimuth Qdp of the antenna 1 are then read, and are compared against values NQpp and NQdp which prevail when the power supply has been turned off previously and which are stored in NRAM 69 (steps 4 and 5). When both of them match, there is no change in the stored data and hence in the attitude of the antenna 1 during a time interval from the time when the power supply has been turned off previously until the power supply is now turned on, and hence the antenna attitude can be controlled in a manner contiguous from a previous control. Accordingly, a previous target value Qppo for the elevation angle of the antenna which is stored in NRAM 69 is delivered to D/A converter 37D, and a previous target value Qdpo for the azimuth of the antenna is delivered to D/A converter 39D (step 7). This produces the same input and output to and from the motor drivers 36 and 38 as the values prevailing when the power supply has been turned off previously.

During the comparison of steps 4 and 5 when actual elevation angle Qpp and actual azimuth Qdp which are read from the antenna 1 do not match the stored values NQpp and NQdp in NRAM 69, this means that the attitude of the antenna 1 has been altered during the time the power supply 29 has been off or that stored data has been destroyed as a result of a reduction in the voltage supplied from the battery 81. Accordingly, the program proceeds to step 6 where the antenna attitude is initialized or to bring it to the origin position and to initialize antenna attitude data. Subsequently, the program proceeds to step 90 shown in FIG. 4*e* where an error is displayed on the CRT display 32 and then returns to a reading of key entry (step 9) which will be described later.

When target values are delivered at step 7, an azimuth Qd is then detected from the gyroscope 63, and is compared against stored value NQd in NRAM 69 which represents the azimuth when the power supply has been turned off previously. A deviation therebetween is written into registers R1Qd, R2Qd which are used to calculate a rate of change during the time interval $t_1$, and into registers R3Qd, R4Qd which are used to calculate a mean value during the time interval $t_2$ (step 8). The deviation represents a difference in the angle of the horizontal axis of gyroscope between when the power supply has been turned on previously and when it is turned on currently, and indicates a difference in the azimuth of the vehicle. The purpose of the step 8 is to correct for a difference in the azimuth of the horizontal axis of the gyroscope. The above has described the initialization which takes place in response to the power supply being turned on. The initialization establishes a continuity between the previous turn-off and the current turn-on of the power supply.

Figure 4B:
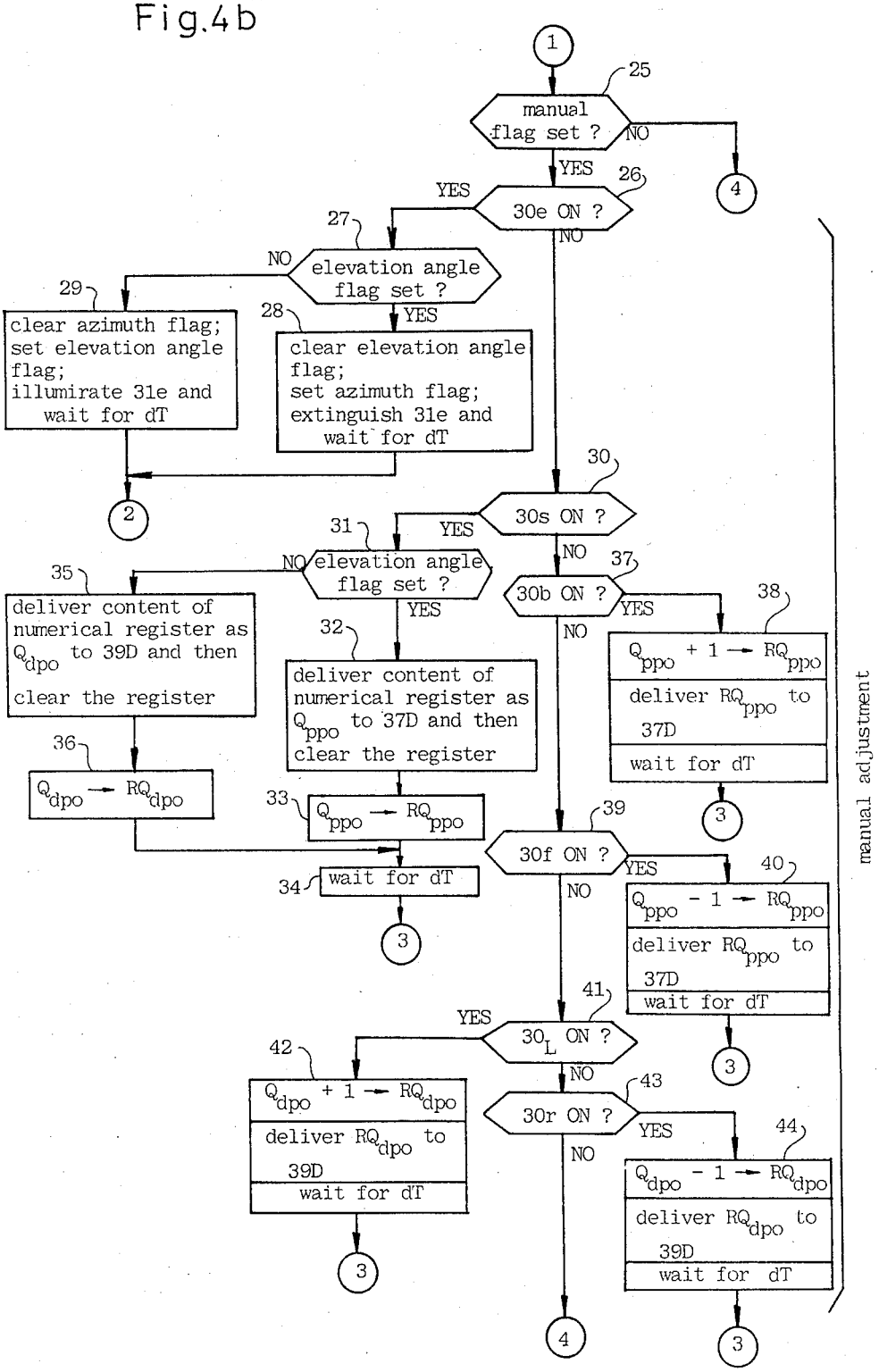

A control over reading an entry by the operating board and over a manual set-up of the attitude in response to a key operation on the operating board are illustrated by steps shown in FIGS. 4*a* and 4*b*, extending from step 9 to step 43.

During a reading of an entry by the keys (step 9), operated keys or keys which have been turned on are decoded, and a code representing an operated key is loaded into a key entry reading register. When a code stored in the reading register is decoded and an associated processing have been completed, the reading register is cleared. In steps which follow step 9, a control flag is set or cleared and an illumination/extinction of an indicator lamp is controlled by reference to the code.

Specifically, when a numerical key is operated, data representing a numerical figure which is assigned to the operated key is written into a numerical register. The number of times the numerical keys are used to provide an entry correspond to digits of a decimal number, and hence a conversion into binary data is performed in a manner dependent on the order of sequence in which a particular numerical key is operated. In this manner, data representing a numerical value which corresponds to the sequence of entry by the numerical keys is written into the numerical register (steps 10 and 11). When the clear key 30*cr* is turned on (step 12), the numerical register is cleared (step 13).

When the manual key 30*m* which demands the manual set-up is operated (step 14), flags which designate other modes are cleared and indicator lamps which indicate other modes are extinguished (step 15), and a flag indicating a manual set-up mode is set and the associated indicator lamp 31*m* is illuminated (step 16). The reception level BSL and the antenna attitude are read (step 17) and displayed on the CRT display 32 (step 18).

This allows an operator or vehicle driver to recognize the current attitude and the level of reception of the antenna 1.

When the fully automatic key 30*fa* which demands a fully automatic mode to be established is operated (step 19), flags indicating other modes are cleared and indicator lamps indicating other modes are extinguished (step 20), and a flag indicating a fully automatic mode is set and the corresponding indicator lamp 31*fa* is illuminated (step 21). The antenna attitude and reception level are read (step 17) and displayed on the CRT display 32 (step 18).

When the semi-automatic key 30*sa* which demands the semi-automatic mode to be established is operated (step 22), flags indicating other modes are cleared and indicator lamps indicating other modes are extinguished (step 23), and a flag indicating the semi-automatic mode is set and the corresponding indicator lamp 31*sa* is illuminated (step 24). The antenna attitude and the reception level are read (step 17) and displayed on the CRT display 32 (step 18).

If the key 30*e* is turned on for the first time when the manual flag is set or when the manual mode is established (step 26), the program proceeds through steps 27 to 29, setting an elevation angle flag, indicating that the elevation angle is being set up, and illuminating the indicator lamp 31*e*. If the key 30*e* is turned on when the elevation angle flag is set (step 26), the program proceeds through steps 27 and 28, clearing the elevation angle flag and setting the azimuth flag and extinguishing the indicator lamp 31*e*. The purpose of the key 30*e* is to specify whether the content of the numerical register represents an elevation angle or an azimuth.

When the set key 30*s* is turned on (step 30), the elevation angle flag is examined to see if it is set or not (step 31), and if it is set, the content of the numerical register is treated as Qppo and is delivered to D/A converter 37D, whereupon the numerical register is cleared (step 32). Qppo is stored in a target value register RQppo (step 33). If the elevation angle flag is reset, the content of the numerical register is treated as Qdpo, and is delivered to D/A converter 39D, whereupon the numerical register is cleared (step 35). Qdpo is stored in a target value register RQdpo (step 36).

Accordingly, when the manual key 30*m* is depressed and then the key 30*e* is depressed to illuminate the indicator lamp 31*e*, with numerical keys being concurrently used to enter a numerical figure, followed by the depression of the set key 30*s*, an elevation angle for the antenna 1 can be established which is equal to an elevation angle entered by the numerical keys. The key 30*e* is then depressed to extinguish the indicator lamp 31*e*, and concurrently the numerical keys are used to enter a numerical figure, followed by the depression of the set key 30*s*, allowing an azimuth for the antenna 1 to be established which is equal to an azimuth entered by the numerical keys.

If the key 30*b* is turned on when the manual flag is set or when the manual mode is established (step 39), a target value supplied to D/A converter 37D is updated or increased by an increment or minimum unit over the previous target value (step 38), whereby the elevation angle of the antenna 1 is stepwise increased. The step-up of the elevation angle takes place at a time interval of dT as long as the key 30*b* remains on, and the step-up operation ceases when the key 30*b* is turned off.

When the key 30*f* is turned on (step 39), a target value supplied to D/A converter 37D is updated or decreased by a decrement or minimum unit over the previous target value (step 40), whereby the elevation angle for the antenna 1 is decreased stepwise. The step-down of the elevation angle takes place continuously at a time interval of dT as long as the key 30*f* remains on, and this operation ceases when the key 30*f* is turned off.

When the key $30_L$ is turned on (step 41), a target value supplied to D/A converter 39D is updated or increased by an increment or minimum unit over the previous target value (step 42), whereby the azimuth of the antenna 1 is increased stepwise. The step-up of the azimuth takes place continuously at a time interval of dT as long as the key $30_L$ remains on, and this operation ceases when the key $30_L$ is turned off.

When the key 30*r* is turned on (step 43), a target value supplied to D/A converter 39D is updated or decreased by a decrement or minumum unit over the previous value (step 44), whereby the azimuth of the antenna 1 is decreased stepwise. The step-down of the azimuth takes place continuously at a time interval of dT as long as the key 30*r* remains on and this operation ceases when the key 30*r* is turned off.

During the step-up or step-down, the prevailing antenna attitude and reception level as updated are displayed on the CRT display 32. This allows an operator or car driver to adjust the antenna 1 for an attitude which provides an optimum reception by observing a display on the CRT display 32.

Figure 4C:
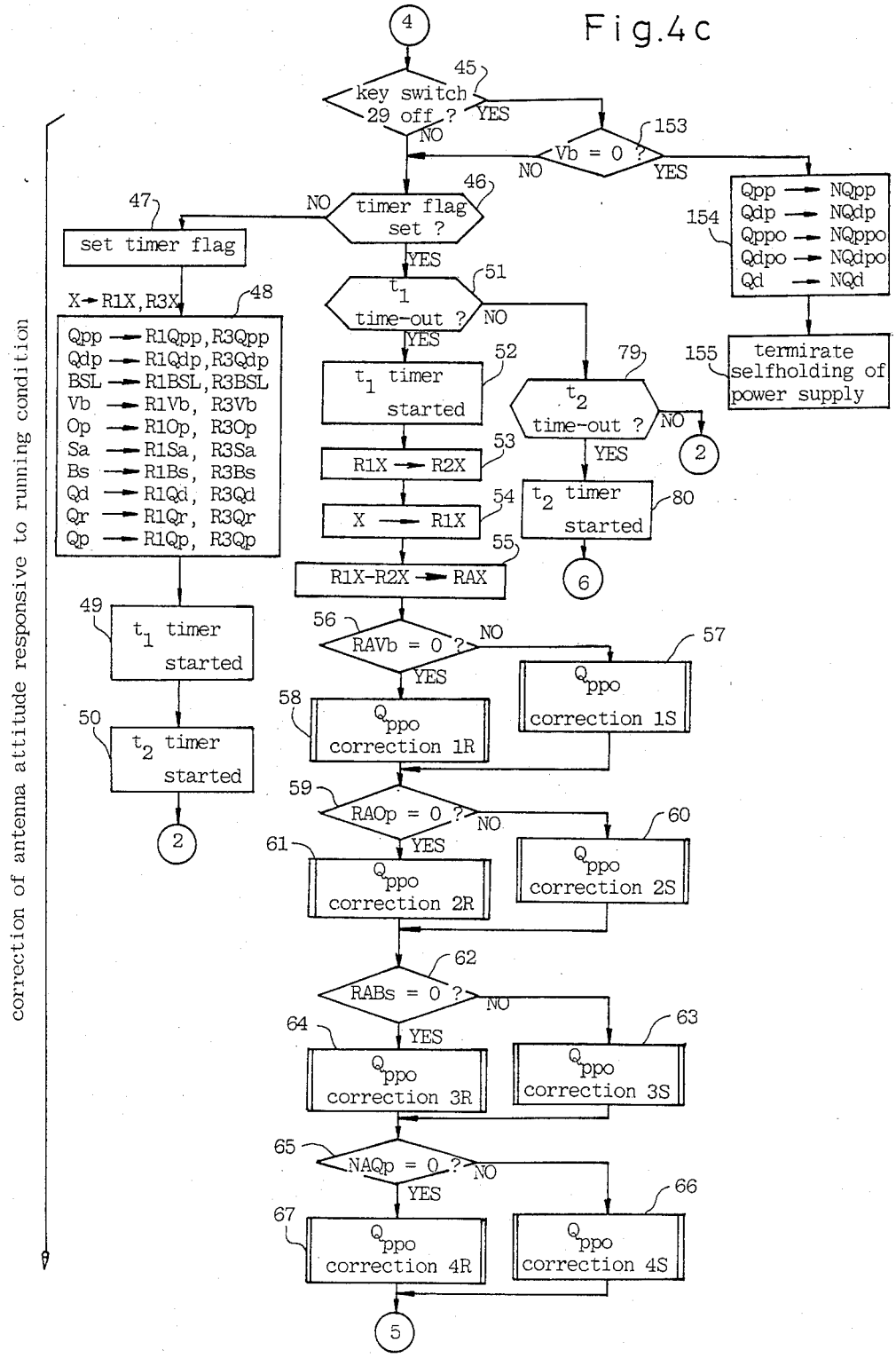

When no key on the operating board 33 are operated, the flowchart for a reading of the entry from the operating board is bypassed, and the program proceeds to a correction of the antenna attitude responsive to running condition, an updating of vehicle location data/correction of antenna attitude, a search for optimum directivity and a correction of vehicle location data which are shown in FIG. 4*c* and subsequent Figures, starting from step 46.

Initially considering a correction of the antenna attitude responsive to running condition, when passing a reading of the entry from the operating board as by bypassing or completing its processing, a timer flag which indicates an entrance into the correction of the antenna attitude responsive to running condition is examined to see if it is set or not (step 46). If the flag is not set, this means that the correction of the antenna attitude responsive to running condition is then entered for the first time, and hence a timer flag is set (step 47) and then the program proceeds to a step 48 where status X is read and written into a current status register R1X which is used to calculate a rate of change and another register R3X which is used to calculate a mean value. In the description to follow, the status X collectively refers to an antenna elevation angle Qpp, antenna azimuth Adp, reception level BSL, speed of running Vp, throttle opening Op, angle of rotation of steering wheel Sa, brake depression Bs, vehicle pitch angle Qp, vehicle roll angle Qr and vehicle azimuth Qp.

A $t_1$ timer is started (step 49), a $t_2$ timer is started (step 50) and then the program returns to the reading of the key entry (step 9). It is to be understood that $t_1$ represents a minimal time interval which is used to calculate the rate of change dX/dT while $t_2$ represents a relatively long time interval which corresponds to the period of updating the vehicle location. After returning to the reading of the key entry (step 9) and when the correction of the antenna attitude responsive to running condition is entered again, the timer flag is now set, so that the program proceeds from step 46 to step 51 where it is examined if the time limit $t_1$ has passed. If the answer is in the negative, the program proceeds to a step 79 where it is determined whether the time limit $t_2$ has passed. If the answer is in the negative again, the program returns to the reading of the key entry (step 9) in order to wait for such time limits to pass. In this manner, the program loops around before proceeding to the correction of the antenna attitude responsive to running condition.

Figure 4D:
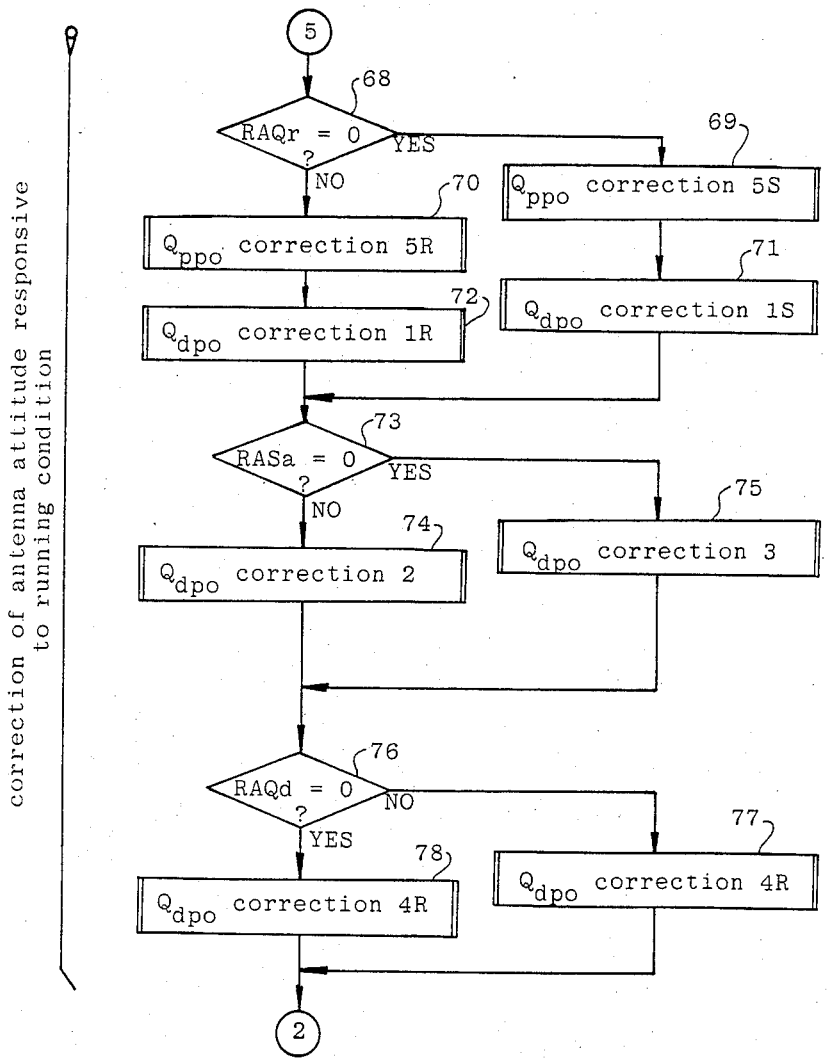

When the time limit $t_1$ has passed, the $t_1$ timer is started again (step 52), whereupon the program execute the correction of the antenna attitude responsive to running condition which are illustrated by steps beginning with a step 53 shown in FIG. 4*c* and continuing to a step 78 shown in FIG. 4*d*. Thus, the correction of the antenna attitude responsive to running condition as illustrated by step 52 to step 58 in FIGS. 4*c* and 4*d* is executed with a period of $t_1$.

Figure 4E:
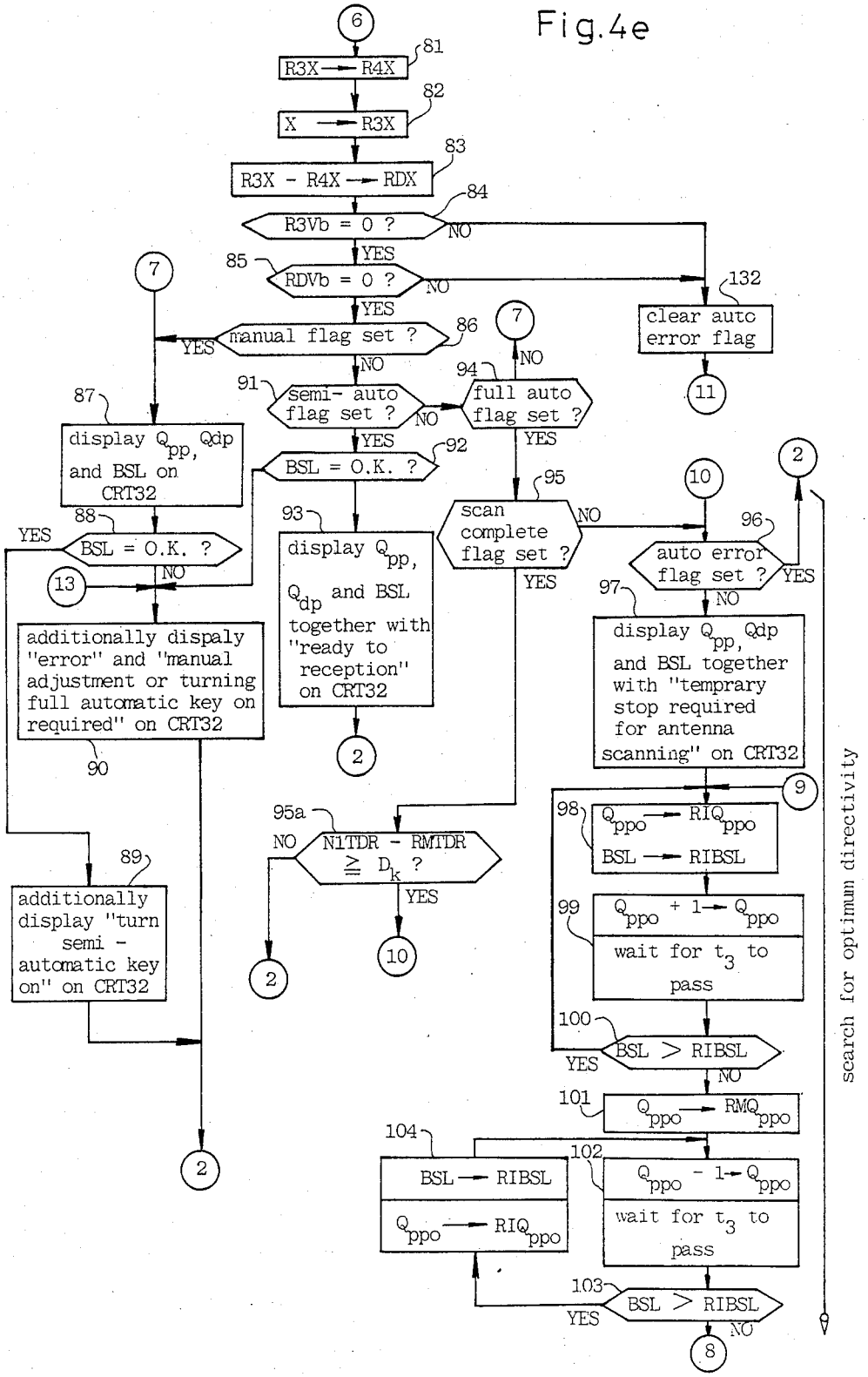
Figure 4F:
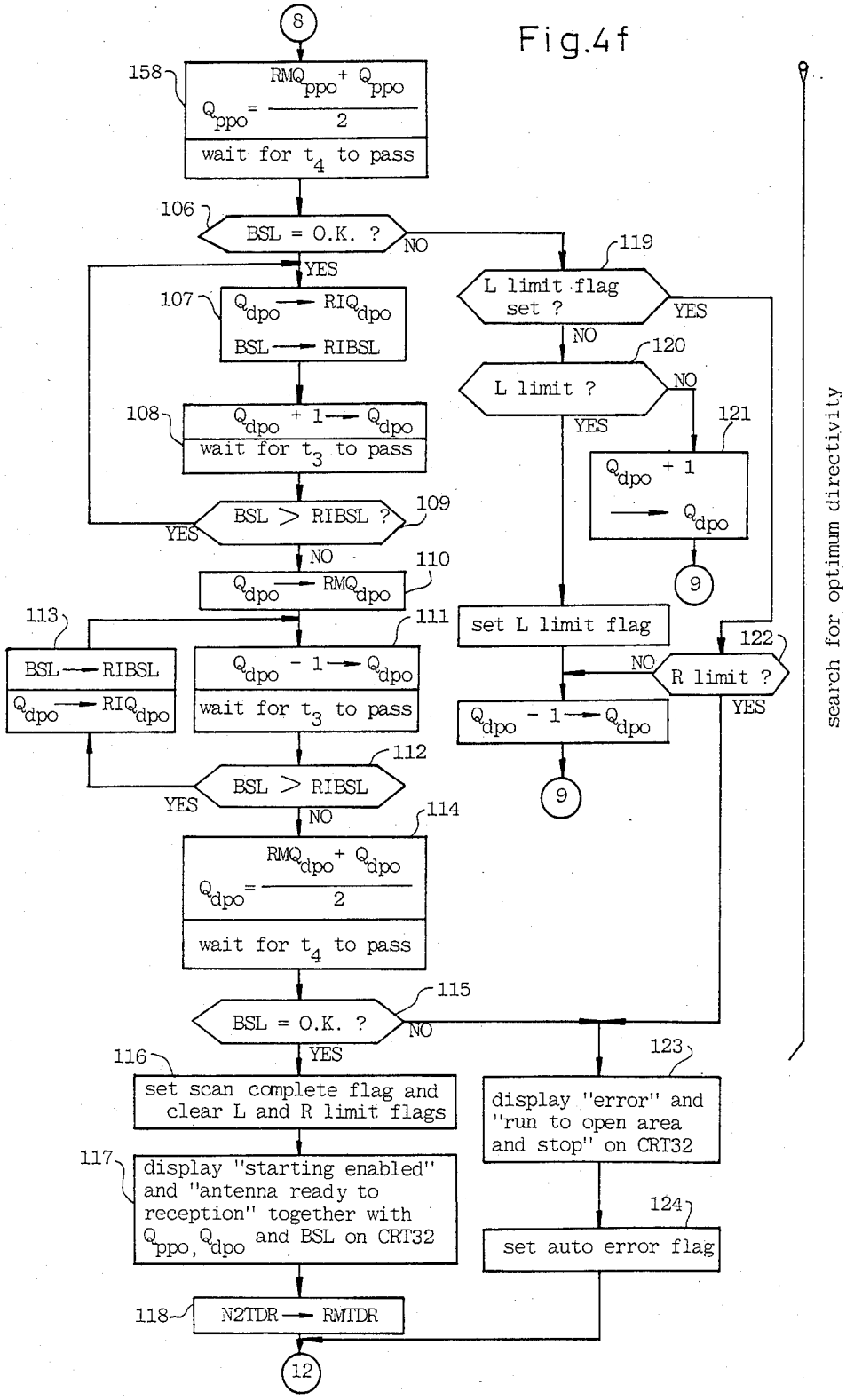
Figure 4G:
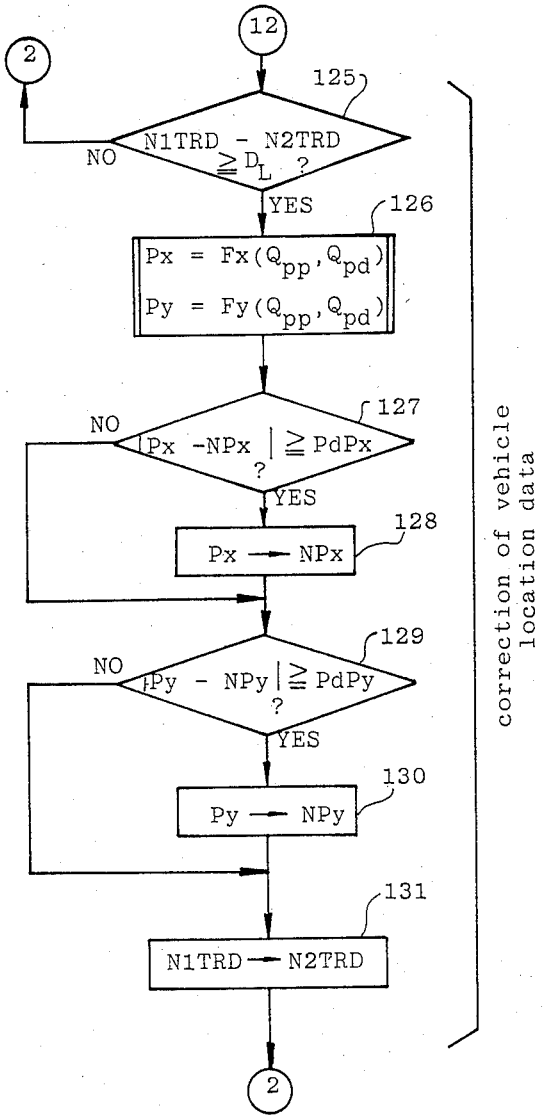
Figure 4H:
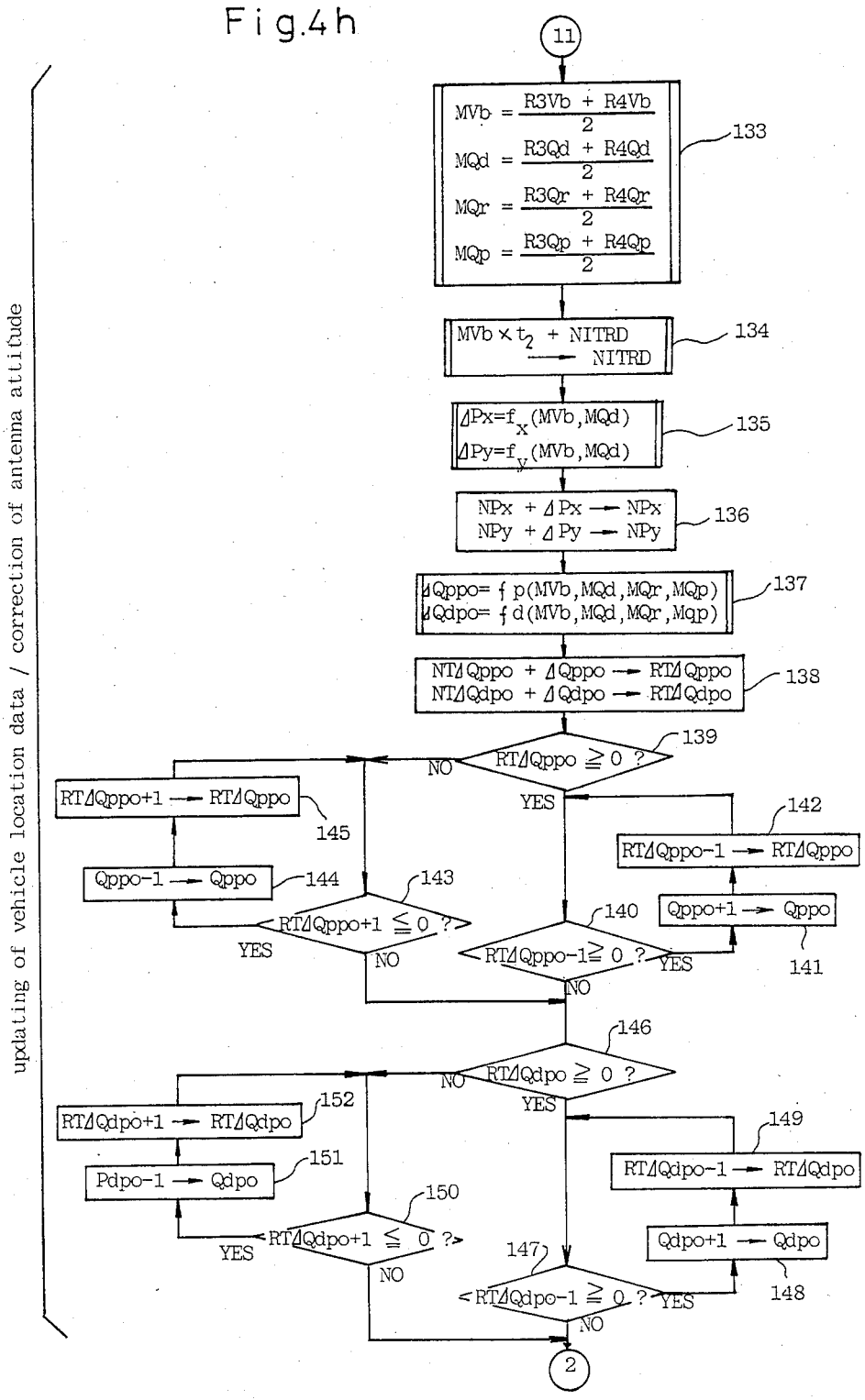

When the time limit $t_2$ has passed, the $t_2$ timer is started again (step 80), the search for optimum directivity illustrated in FIGS. 4*e* and 4*f* and beginning from step 81, the correction of vehicle location data illustrated in FIG. 4*g* and the updating of vehicle location data/correction of antenna attitude illustrated in FIG. 4*h* are executed. Thus, the search, the correction of location data and the updating of location data/correction of antenna attitude are executed with a period $t_2$.

The correction of the antenna attitude responsive to running condition which takes place with a period $t_1$ will be described first. When it is determined at step 51 that the time limit $t_1$ has passed, the $t_1$ timer is started again (step 52), and the content of the current status register R1X is transferred to the previous status register R2X (step 53) where X stands for Qpp, Qdp, BSL, Vb, Op, Sa, Bs, Qp, Qr and Qp as mentioned previously. The current status X is read and stored in the current status register R1X (step 54). The content of the previous status register R2X is subtracted from the content of the current status register R1X to derive a value AX (where X stands for Qpp, Qdp . . . Qp as before), which is stored in a rate of change register RAX (where X again stands for Qpp, Qdp, . . . QP) (step 55). In this manner, a rate of change in each status is stored in the register RAX.

Next, the rate of change in the vehicle speed Vb, namely, the acceleration (either positive or negative) RAVb is examined. If it is not substantially equal to zero, the program proceeds to a step 57 where the antenna attitude is corrected in advance in anticipation of the acceleration. If the rate of change is substantially equal to zero, the program proceeds to a step 58 where a correction in advance of the antenna attitude which has been established up to that point is modified. The detail of the step 57 is illustrated in FIG. 5*a* while the detail of the step 58 is illustrated in FIG. 5*b*.

Figures 5A, 5B:
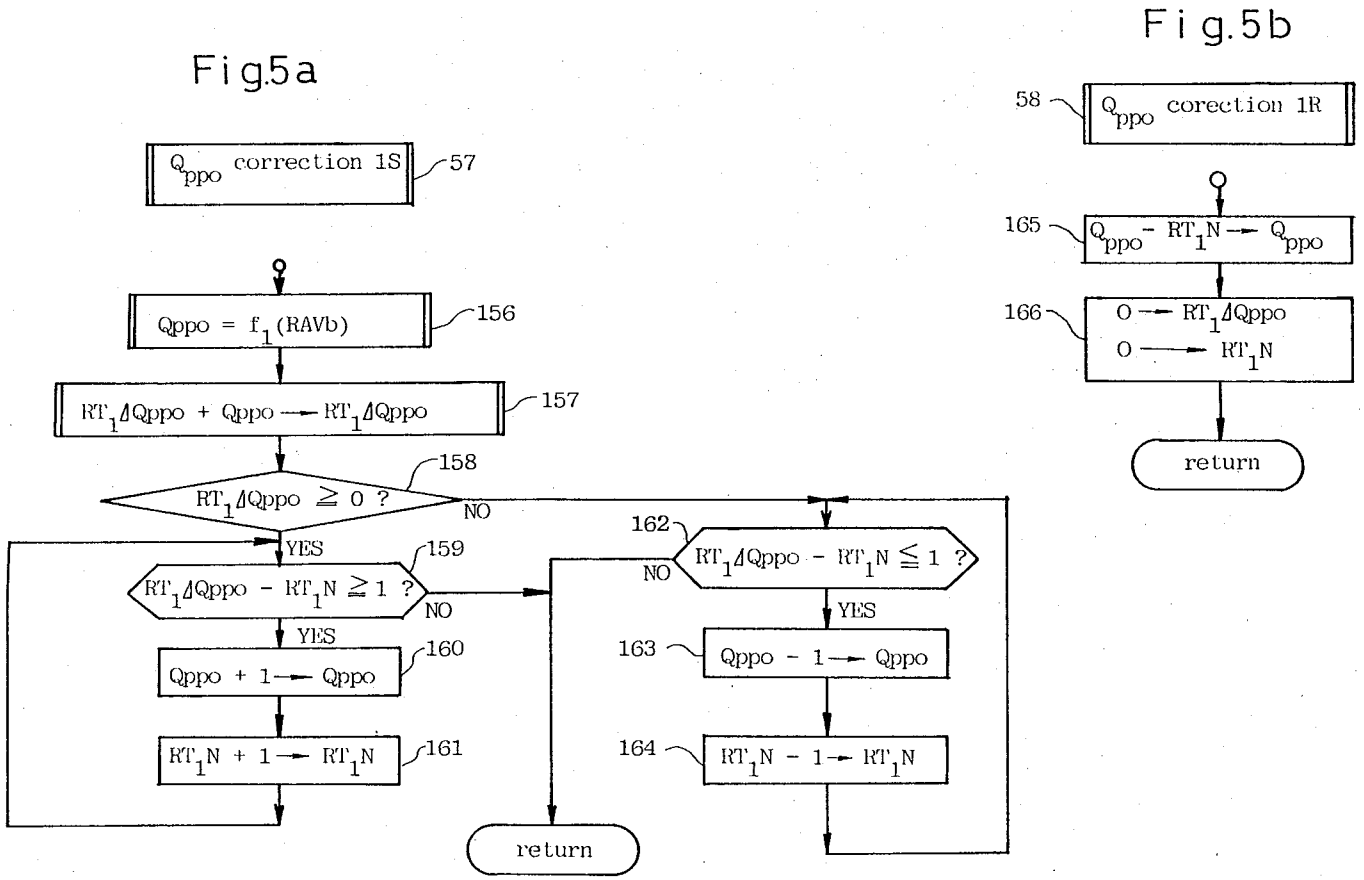
FIG. 5*a* is a flowchart illustrating the detail of a control operation at a particular step shown in FIG. 4*c*.
FIG. 5*b* is a flowchart illustrating the detail of a control operation at another particular step shown in FIG. 4*c*.

Initially referring to FIG. 5*a* for a description of a correction in advance responsive to the acceleration, a corrected antenna elevation angle value $\Delta Qppo = f_1$ (RAVb) which corresponds to the acceleration RAVb is calculated (step 156). In this embodiment, ROM stores in-advance corrected values for the elevation angle corresponding to various values of the acceleration RAVb which are utilized as addresses, and thus the in-advance corrected value is obtained by translating the detected acceleration into a corresponding address data and reading ROM at the address thus obtained. The in-advance corrected value ΔQppo is added to the content of an in-advance corrected value accumulation register $RT_1\Delta Qppo$, and the sum is stored into the register to update it (step 157). The content of the register is examined to see if it is positive or negative (step 158), and when the content is positive, a determination is then made to see if the content is equal to or greater than the minimum unit 1 (step 159). If the content is greater, the target value Qppo is updated or incremented by one increment or minimum unit 1, and the updated value is delivered to D/A converter 37D (step 160), thus updating the register $RT_1N$ which indicates a modified target value to an incremented value. The program then returns to the step 159 to see if the updated value is still equal to or greater than the minimum unit 1. If it is not, the program returns to the main routine at step 59.

Conversely, when the corrected value accumulation register $RT_1\Delta Qppo$ has a negative content, a determination is made at step 162 to see if the content is less than the minimum unit "−1". If it is, the target value Qppo is updated to a decremented value which is reduced by the minimum unit, and is then delivered to D/A converter 37D (step 163), thus updating the register $RT_1N$ to the decremented value. The program then returns to the step 162 again to see if the updated content is still less than the minimum unit "−1". If it is not, the program returns to the main routine at step 59. In this manner, when the acceleration, inclusive of deceleration, of an increased magnitude continues, the elevation angle of the antenna 1 is stepwise changed, and the stepwise modified value during the acceleration is stored in the register $RT_1N$, with the sum of the number of minumum units which are thus allowed with the remainder less than the minimum unit being stored in the register $RT_1\Delta Qppo$.

Referring to FIG. 5*b*, a modification for the in-advance correction of the antenna attitude during the step 58 will be described. When the acceleration is substantially equal to zero, the target value Qppo is modified to the preset value from which the content of the register $RT_1N$, which represents a stepwise corrected value during the acceleration is subtracted, and the accumulation registers $RT_1\Delta Qppo$ and $RT_1N$ are cleared. The program then returns to the main routine at step 59.

As a result of the correction of the antenna attitude during the acceleration, the elevation angle of the antenna is corrected in a manner depending on the acceleration when an acceleration of an increased magnitude prevails, and when the acceleration ceases, the attitude is returned to that which the antenna assumed before the acceleration. In this manner, the correction of the antenna attitude in anticipation of nose-up or nose-down during a rapid acceleration or deceleration can be realized.

Upon completing the correction of the antenna attitude with reference to the acceleration RAVb, the correction of the antenna attitude responsive to the rate of change in the throttle opening RAOp is entered. Again a rate of change (either positive or negative) in the throttle opening Qp, RAOp is examined, and if it is not substantially equal to zero, the program proceeds to a step 60 where the antenna attitude is corrected in advance in anticipation of the rate of change, and if it is substantially equal to zero, the program proceeds to a step 61 where an in-advance correction of the antenna attitude that has been prevailing up to that point is modified. The control which takes place during the step 60 is similar to the control in the step 57 mentioned above, and therefore will not be specifically described. Similarly, the control in the step 61 is similar to the control in the step 58 mentioned above, and therefore will not be specifically described. Again, the antenna attitude is corrected in anticipation of nose-up or nose-down during a rapid acceleration or deceleration.

Upon completing the correction of the antenna attitude responsive to the rate of change in the throttle opening RAOp, the correction of the antenna attitude responsive to the rate of change in the brake depression RABs is entered. Again, a rate of change in the brake depression RABs is initially examined, and if it is not substantially equal to zero, the program proceeds to a step 63 where the antenna attitude is corrected in advance in anticipation of such rate of change, and if it is substantially equal to zero, the program proceeds to a step 64 where an in-advance correction of the antenna attitude that has been prevailing up to that point is modified. The control in the step 63 is similar to the control in the step 57 mentioned above, and therefore will not be specifically described. Similarly, the control in the step 64 is similar to the control in the step 58 mentioned above, and therefore will not be specifically described. As a result of such controls, the correction of the antenna attitude in anticipation of nose-up or nose-down during a rapid acceleration or deceleration which may occur during a rapid application of braking or its release is realized.

The antenna attitude is then corrected in response to the rate of change RAQp, in the pitch angle of the vehicle, Again, the rate of change RAQp in the pitch angle of the vehicle is examined, and the program proceeds to a step 66 where an in-advance correction of the antenna attitude is made in accordance with the rate of change if the latter is not substantially equal to zero, and the program proceeds to a step 67 where an in-advance correction of the antenna attitude which has been prevailing up to that point is modified if the rate of change is substantially equal to zero. The control in the step 67 is similar to the control in the step 57 mentioned above, and therefore will not be specifically described. The control in the step 68 is similar to the control in the step 58 mentioned above, and therefore will not be specifically described. As a result of such control, an adjustment of the antenna attitude in anticipation of a rapid pitching of the vehicle is realized.

Next, the antenna attitude is corrected in response to the rate of change, RAQr, in the roll angle of the vehicle. Again, the rate of change, RAQr in the roll angle of the vehicle is examined, and the program proceeds to steps 69 and 71 where the antenna attitude is corrected in advance with respect to the elevation angle and the azimuth so as to correspond to the rate of change if the rate of change is not substantially equal to zero, and the program proceeds to steps 70 and 72 where the correction depending on the rate of change is modified if the rate of change is substantially equal to zero. The control in the steps 69 and 71 is similar to the control in the step 57 mentioned above, and therefore will not be specifically described. The control in the steps 70 and 72 is similar to the control in the step 58 mentioend above, and therefore will not be specifically described. As a result of such control, a regulation of the antenna attitude in anticipation of a rapid rolling motion of the vehicle is realized.

Figure 6A:
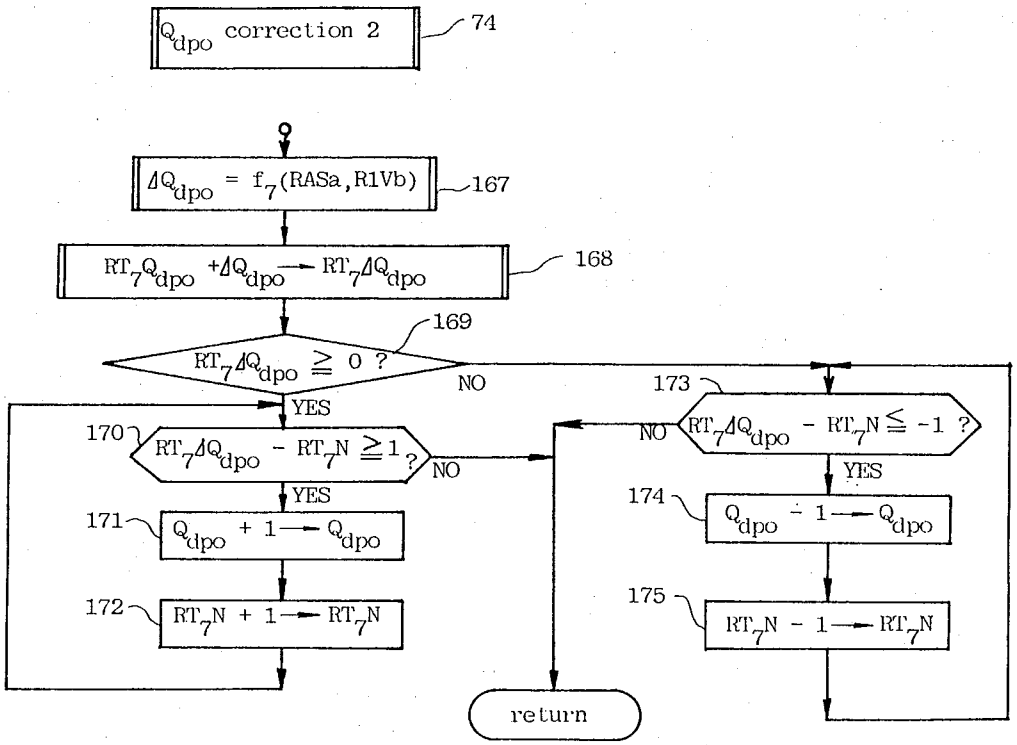
FIG. 6*a* is a flowchart illustrating the detail of a control operation at a particular step shown in FIG. 4*d*.
Figure 6B:
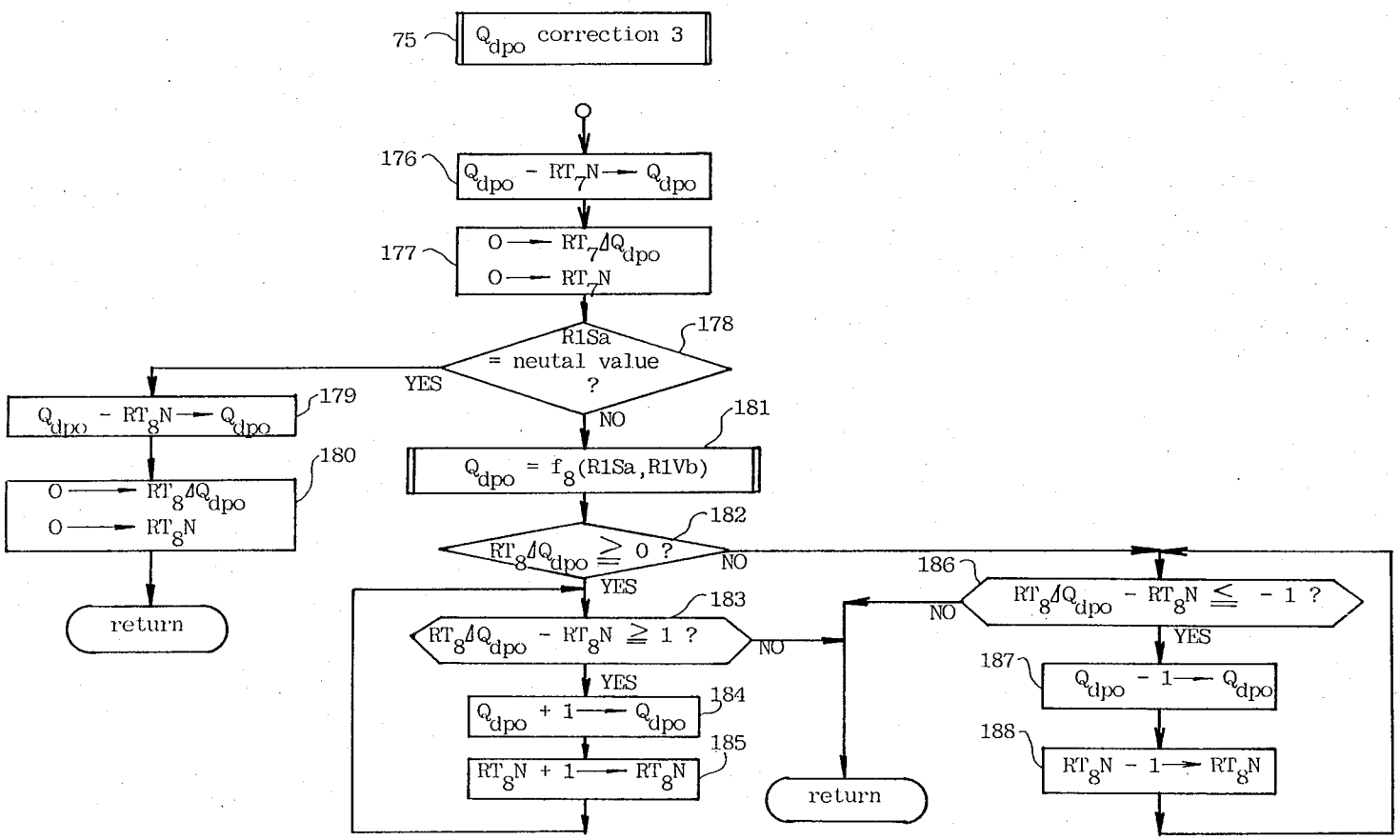
FIG. 6*b* is a flowchart illustrating the detail of a control operation at another particular step shown in FIG. 4*d*.

The antenna attitude is then corrected in accordance with the rate of change, RASa, in the angle of rotation of the steering wheel as well as the angle of rotation of the steering wheel Sa. The correction of the antenna attitude which takes place at step 75 when the rate of change RASa is not substantially equal to zero is shown in detail in FIG. 6*a*. It is to be understood that the correction which responds to this rate of change is similar to the detail of the correction of the antenna attitude which takes place in the step 57 mentioned above. However, it will be noted that a change in the direction of travel of the vehicle or a change in the roll angle of the vehicle in response to an operation of the steering wheel also depends on the angle of rotation of the steering wheel as well as the vehicle speed. For this reason, the degree at which the correction is made is referenced to or accessed by a change in the angle of rotation of the steering wheel and the vehicle speed. As a result of such control, the in-advance correction of the antenna attitude when the steering wheel is sharply turned or returned is realized. The correction of the antenna attitude which takes place at step 75 when the rate of change RASa in the angle of rotation Sa of the steering wheel is substantially equal to zero is shown in detail in FIG. 6*b*. In the similar manner as mentioned in connection with the step 58, the magnitude of correction responsive to the rate of change is cleared (steps 176 and 177), but a correction of the antenna attitude in accordance with the angle of rotation of the steering wheel Sa is performed at steps 178 to 188. It will be seen that the vehicle changes its direction of travel unless the angle of rotation of the steering wheel Sa is 0 or at its neutral point if a rate of change in the angle of rotation of the steering wheel remains zero. The purpose of steps 178 to 188 is to provide a correction in anticipation of such change in the direction of travel. Specifically, if the angle of rotation of the steering wheel Sa is not zero (not at its neutral position) (step 178), ROM is accessed in terms of the prevailing value of the angle of rotation of the steering wheel R1Sa and the speed R1Vb to read an attitude correction ΔQdpo, which is added to the content of an accumulation register $RT_8\Delta Qdpo$, thus updating this register (step 181). It is then determined from the accumulation register $RT_8\Delta Qdpo$ and the content of the correction register $RT_8N$ if the updated value permits a change by the minimum unit 1, and if it is permitted, the target value is modified by the minimum unit and the modified value is delivered to D/A converter 39D (steps 181 to 188). When the steering wheel is returned to its neutral position, the target value is returned to the value which it assumed before the steering wheel has been turned, and the registers $RT_8\Delta Qdpo$ and $RT_8N$ are cleared. The direction of travel of the vehicle changes as the steering wheel is turned, and the vehicle continues to travel in the changed direction. The correction of the antenna attitude and the correction of vehicle location which respond to such change in the direction of travel take place in the updating of vehicle location data/correction of antenna attitude occurring at a period of $t_2$ which will be described later. The correction of the antenna attitude as mentioned above and the correction of the antenna attitude responding to a rate of change in the azimuth of the vehicle which will be described next are both temporary corrections responding to a relatively rapid change in the status which are effected in order to prevent a tracking lag.

When the program exits from the step of correcting the antenna attitude in accordance with the angle of rotation of the steering wheel as well as a rate of change therein as mentioned above, the program then enters the correction of the antenna attitude in accordance with the rate of change RAQb in the azimuth of the vehicle. Again, the rate of change RAQb in the azimuth of the vehicle is examined, and the program proceeds to a step 77, where the antenna attitude is corrected in advance in anticipation of such rate of change if the rate of change is not substantially equal to zero, and proceeds to a step 78 where an in-advance correction of the antenna attitude that has been prevailing up to that point is modified if the rate of change is substantially equal to zero. The control in the step 77 is similar to the control in the step 57 mentioned above, and therefore will not be specifically described. Also, the control in the step 78 is similar to the control in the step 58 mentioned previously, and therefore will not be specifically described. It is to be noted, however, that the azimuth of the antenna is corrected. As a result of such control, a regulation of the antenna attitude in anticipation of any rapid change in the orientation or the direction of travel of the vehicle is realized.

What has been described above is the correction of the antenna attitude responsive to running condition which takes place with the period $t_1$. The updating of vehicle location data/correction of antenna attitude which takes place with the period $t_2$ will now be described. If it is determined at step 79 shown in FIG. 4*c* that the time limit $t_2$ has passed, the $t_2$ timer is started again (step 80), and the program proceeds to step 81 shown in FIG. 4*e* where the content of the current status register 3X is transferred to a previous status register 4X, and the current status X is read and written into the current status register 3X (step 82). The content of the previous status register 4X is subtracted from the content of the current status register 3X to derive a change DX which occurred during the time interval $t_2$, which is written into a change register RDX (step 83). A current vehicle speed register R3Vb within the current status register R3X is examined (step 84) to see if the current vehicle speed R3Vb is or is not equal to zero. If it is equal to zero, a portion of the change register RDX which indicates a change in the vehicle speed, also designated as R3Vb, is examined to see if the change is or is not equal to zero (step 84). If the change is equal to zero, or if there is no change in the vehicle speed, it is truthfully concluded that the vehicle is substantially and completely at rest. Accordingly, the program proceeds to step 86 and subsequent steps where a mode specified by a key or keys is executed. There is no need to correct the antenna attitude or to update vehicle location data, and hence the updating of vehicle location data/correction of antenna attitude is not executed. The control of such mode will be described later.

If the current vehicle speed is not equal to zero or if it is zero, but there is a finite change in the vehicle speed from the previous value, it is justifiably determined that the vehicle is not completely at rest, and an automatic error flag which is utilized in the mode control to be described later is cleared (step 132), and the program proceeds to step 133 shown in FIG. 4*h* where the updating of vehicle location data/correction of antenna attitude is initiated. Specifically, at step 133, a mean vehicle speed MVb, a mean azimuth MQd of the vehicle, a mean roll angle MQr and a mean pitch angle MQp during the time interval $t_2$ are calculated using the previous and the current values, and then a distance travelled by the vehicle, $MVb \times t_2$ is derived, which is added to the content of a total running distance register which is allocated within NRAM 69, with the sum being used to update the distance register NlTRD (step 134). This represents the updating of a running distance. A change in the location of the vehicle ΔPx, ΔPy is calculated on the basis of the mean azimuth MQd and the mean speed MVb (or the distance travelled, since $t_2$ represents a fixed value) (step 135). This calculation takes place by substituting individual parameters into formulae which are assembled into the program. The change in the vehicle position ΔPx, ΔPy is added to the content of the current location register NPx, NPy which is allocated within NRAM 69, with the sum being used to update the current location register (step 136). The described operation has updated the current vehicle location data.

The amount of correction ΔQppo, ΔQdpo which are to be applied to correct the antenna attitude in response to changes in the azimuth, speed, roll and pitch angles are calculated on the basis of the means azimuth MQd, the mean speed MVb, the mean roll angle MQr and the mean pitch angle MQp (step 137). Again, this calculation takes place by substituting individual parameters into the formulae which are assembled into the program. The calculated values ΔQppo, ΔQdpo are added to the content of two fraction registers NTΔQppo, NTΔQdpo which are allocated within NRAM 69, with the sums being used to update these fraction registers (step 138). The purpose of steps 139 to 152 is to subtract 1 from the content of the respective fraction registers until the content of the fraction registers (in absolute value) becomes less than the minimum unit 1, while modifying the target values Qppo, Qdpo by one which are delivered to D/A converters 37D, 39D. Accordingly, subsequent to these steps, the absolute value of the content of the fraction registers NTΔQppo, NTΔQdpo is less than 1, maintaining a fractional value for which an adjustment could not have been made. This represents the correction of the antenna attitude.

The correction of the vehicle location data and the correction of the antenna attitude responsive to running distance as mentioned above (steps 133 to 153) are repeated with a period of $t_2$ when the vehicle is substantially running, meaning that the vehicle speed is not equal to zero, or if it is equal to zero, there is a finite change in the vehicle speed during the time interval $t_2$.

When the vehicle is substantially at rest, the program enters the mode control shown in FIGS. 4*e* 4*f* and 4*g*, starting from step 86 shown in FIG. 4*e*. At this time, the manual flag is initially examined (step 86), and if it is set, the current antenna attitude data and reception level are read and are displayed on CRT 32 (step 87). The reception level BSL is compared against a reference value to determined if it is proper or improper (step 88). If a proper reception level is found, indicating that the antenna attitude is well established, a legend "turn semi-automatic key on" is additionally displayed on CRT 32 (step 89). If the reception level is improper, indicating that the antenna attitude is not well established, legends "error" and "manual adjustment or turning full automatic key on required" are additionally displayed on CRT 32 (step 90). In the event the manual flag is not set, the semi-automatic flag is exmained if it is set (step 91), and if it is set, the reception level is compared against the reference value. If an improper reception level is found, the program proceeds to step 90. If a proper reception level is found, a legend "ready to reception" is displayed on CRT together with the current status.

If the semi-automatic flag is not set, fully automatic flag is examined (step 94), and if it is not set, the program proceeds to step 87. If the fully automatic flag is set, the program proceeds to step 87. If the fully automatic flag is set, a scan complete flag indicating a successful completion of the automatic search for optimum directivity, which will be described later, is examined, and if it is not set, an automatic error flag which indicates the disablement of the automatic flag for optimum directivity due to the interception of a radio wave by obstacles is examined, and if the automatic error flag is not set, the current status (Qpp, Qdp, BAL) and a legend "temporary stop required for antenna scanning" are displayed on CRT 32 in order to search for the optimum point (step 97). The current elevation angle target value Qppo is stored in a save register RIQppo and a current reception level is stored in a save register RIBSL (step 98), and the target value Qppo of the elevation angle is updated to one increment greater than the minimum value for delivery to D/A converter 37D, and the program then waits for a time interval $t_3$ which is required for a movement for one increment to pass (step 99). In this manner, the elevation angle Qpp of the antenna 1 is incremented by one minimum unit 1. The reception level BSL is then read, and is compared against the previous value RIBSL which is saved. If the current reception level is higher, the program returns to step 98 where the prevailing target value of the elevation angle and the reception level are stored in save reigsters, and the target value of the elevation angle is updated by one increment or by one mininum unit 1. Thie operation is repeated as long as the new reception level is higher than the previous reception level. If the new reception level fails to exceed the previous reception level, it is assumed that this represents a first optimum point for the elevation angle and the prevailing target value is stored in a peak elevation angle register RMQppo (step 101). Steps 102 to 104 are then used to read the reception level while decrementing the elevation angle in steps of minimum unit 1, thus allowing the elevation angle of the antenna to be reduced as long as the new reception level remains higher than the previous level. If the new reception level fails to be greater than the previous level, it is assumed that this represents a second optimum point for the elevation angle, and the program proceeds to step 105 shown in FIG. 4*f* where a mean value of the first and the second optimum point is calculated and delivered to D/A converter 37D as a target value Qppo. The reception level BSL is then read again, and a determination is made to see if it is a proper value. If it is, this means that the optimum point for the elevation angle has been detected and established, and therefore the program proceeds to the search for the optimum point of azimuth Qdp which beings with step 107. However, if the reception level is found to be improper, it is uncertain whether the optimum elevation angle has been established. Accordingly, an L limit flag indicating that the azimuth has been changed to the left limit or at the point corresponding to 180° in a circle of 0° to 360° is examined at step 119, and if it is not set, a determination is made to see if the left limit is reached (step 120), if the left limit is not reached, the azimuth Qdpo is updated by incrementing by minimum unit 1 (step 121). If the left limit is reached, the L limit flag is set, and the search for the optimum elevation angle including steps 98 to 106 is performed again. In this manner, if one cycle of the search for the optimum elevation angle fails to produce a proper reception level, the azimuth is changed by minimum unit 1, followed by another cycle of the search for the optimum elevation angle. When the azimuth has reached the left limit, the search for the optimum elevation angle is then repeated by stepwise decrementing the azimuth. If the proper reception level is not obtained when the azimuth reaches the right limit (step 122), the search for the optimum directivity is disabled, possibly due to the fact that vehicle is located behind an obstacle for the radio wave. Accordingly, legends "error" and "run to open area and stop" are additionally displayed on CRT 32 (step 123) and the automatic error flag is set (step 124). When the automatic error flag is set, the search for the optimum directivity cannot be initiated since this flag is referred to at step 96. As shown, step 132 in FIG. 4*e*, the automatic error flag cannot be cleared unless the vehicle substantially runs, and hence the search for the optimum directivity which is repeated can be initiated after running and stopping the vehicle.

When the optimum elevation angle has been successfully searched and established up to step 106, steps 107 to 115 are utilized to effect the search for the optimum azimuth in the similar manner as in the search for the optimum elevation angle. If this search is disabled, the program proceeds to step 123. When the optimum azimuth has been searched and successfully established, the scan complete flag, indicating that the search for the optimum directivity has been successfully completed after turning the power supply on is set, the L and R limit flags are cleared (step 116), and legends "starting enabled", "antenna ready to reception" as well as the elevation angle Qppo, the azimuth Qdpo and the reception level BSL are displayed on CRT 32, and the prevailing the running distance data N2TDR is stored in a register RMTDR which stores the running distance data at the time the search for the optimum directivity is made (step 118). The program then proceeds to step 125 shown in FIG. 4*g* where a difference between the current total running distance data N1TRD and the running distance data N2TRD which is obtained when the vehicle location has been updated previously is calculated to see if the difference is greater than a given $D_L$, which may be 100 km, for example (step 125). If the difference is greater than the given value, this means that it is now the time to update the vehicle location. Accordingly, the elevation angle Qpp and the azimuth Qdp of the antenna 1 are substituted in the formulae to calculate the vehicle location Px, Py (step 126). During steps 127 to 130, the calculated value is compared against the current location data NPx, NPy to derive deviations PdPx, PdPy, which causes the current location data to be replaced by the calculated value if the deviations exceed the given values. This represents the updating of the vehicle location data based on the antenna attitude. The current total running distance data N1TRD is stored in the register N2TRD as the updated running distance. It will thus be seen that the updating of the vehicle location data takes place when the running distance since the previous updating is greater than $D_L$ and when the vehicle is at rest and the search for the optimum directivity has been successfully completed.

When the search for the optimum directivity has been successfully completed for the first time since the power supply has been turned on, the scan complete flag is set as previously mentioned, provided that the fully automatic key 30*fa* is turned on to set the fully automatic flag. If the fully automatic flag is set, the program proceeds to steps 94, 95 when the vehicle is at rest, but since the scan complete flag is set, the program now proceeds to step 95*a* where the running distance RMTDR which is obtained when the previous search for the optimum directivity has been completed is compared against the current running distance NITDR, and if a difference therebetween is equal to or greater than Dk, which may be equal to 10 km, for example, the program then proceeds to the search for the optimum directivity which begins with steps 96, 97. If the difference is less than Dk, the program does not proceed to the search for the optimum directivity.

To summarize, the search for the optimum directivity is executed for the first time when the fully automatic flag is set and the vehicle is at rest after the power supply has been turned on, and takes place subsequently under the same condition plus the requirement that the vehicle has run more than Dk since the previous search. Upon completion of the search, the updating of vehicle location is effected on the basis of the antenna attitude, provided the vehicle has run more than DL since the previous updating of vehicle location.

When the engine key key 29 is turned off, the program proceeds from step 45 in FIG. 4*c* to step 153 where the current vehicle speed Vb is read. If Vb is equal to 0, indicating that the vehicle is at rest, the prevailing elevation angle target value Qppo, elevation angle Qpp, azimuth target value Qdpo, the azimuth Qdp and the vehile azimuth Qd are stored in NRAM 69 (step 154), and the self-holding action for the power supply is terminated by turning the relay 30 off (step 155). If the vehicle speed is not equal to zero, the program waits for the vehicle speed to become zero. Thus the self-holding action for the power supply is continued, thus continuing various controls.

While a particular embodiment of the invention has been described above, it should be understood that the invention can be carried out in other manners not specifically described herein. For example, while updating of vehicle location data and correction of the antenna attitude responsive to the running distance takes place at a time interval of $t_2$, such operation may take place in response to a given count in a counter which counts vehicle speed pulses, which are developed for a revolution of a vehicle speedmeter cable through a given angle. In this instance, the correction takes place for each running distance, and any error produced in the calculation can be reduced. In the described embodiment, the correction of the antenna attitude responsive to running condition takes place in response to the calculation of a correction in each status parameter. However, all of status parameters may be input to a single formula to derive a correction value, which may be used as the bases to correct the antenna attitude. Alternatively, by calculating a correction value for each status parameter, and adding these correction values together, a sum can be obtained which may be used as the basis for the correction of the antenna attitude.

From the foregoing, it will be seen that the antenna attitude is corrected on the basis of the detection of a rate of change in the attitude of a mobile body, so that the antenna attitude can be corrected rapidly and smoothly following a change in the attitude of the mobile body for a mobile body which frequently changes its attitude or for a mobile body which changes attitude less frequently, but which undergoes a rapid change, thus achieving a favorable reception by the antenna. In particular, the invention is useful with a mobile body such as a vehicle, in particular, an automobile, which experiences a rapid and large change in the attitude.

What is claimed is:

1. Attitude control system for antenna on mobile body for maintaining it in opposing relationship with a stationary object comprising:

a first drive mechanism for driving an antenna for rotation about a horizontal axis on the mobile body;

first energizing means responsive to first attitude information for energizing the first drive mechanism to establish an angle of rotation of the antenna which is specified by the first attitude information;

a second drive mechanism for driving the antenna for rotation about a vertical axis on the mobile body;

second energizing means responsive to second attitude information for energizing the second drive mechanism to establish an angle of rotation of the antenna which is specified by the second attitude information;

means for detecting the distance travelled by the mobile body;

means for detecting an attitude of the mobile body;

rate of change detecting means for detecting a rate of change of a steering member of the mobile; and attitude control means for supplying the first and the second attitude information to the first and the second energizing means, respectively, for correcting the first and second attitude information dependent on the distance travelled and the attitude for maintaining the attitude of the antenna in opposing relationship with the stationary object, and for updating the first and the second attitude information which is supplied to the energizing means;

said attitude control means calculating in advance a correction value corresponding to the rate of change and updating the second attitude information for predictive correction of the attitude of the antenna.

2. Attitude control system for antenna on mobile body for maintaining it in opposing relationship with a stationary object comprising:

a first drive mechanism for driving an antenna for rotation about a horizontal axis on the mobile body;

first energizing meand responsive to first attitude information for energizing the first drive mechanism to establish an angle of rotation of rotation of the antenna which is specified by the first attitude information;

a second drive mechanism for driving the antenna for rotation about a vertical axis on the mobile body;

second energizing means responsive to second attitude information for energizing the second drive mechanism to establish an angle of rotation of the antenna which is specified by the second attitude information;

means for detecting the distance travelled by the mobile body;

means for detecting an attitude of the mobile body;

means for detecting a position of steering member of the mobile; and attitude control means for supplying the first and the second attitude information to the first and the second energizing means, respectively, for correcting the first and the second attitude information dependent on the distance travelled and the attitude for maintaining the attitude of the antenna in opposing relationship with the stationary object, and for updating the first and the second attitude information which is supplied to the energizing means;

said attitude control means calculating in advance a correction value corresponding to the position of the steering member and the speed of the mobile body and updating the second attitude information for predictive correction of the attitude of the antenna.

3. Attitude control system as set forth in claim 2 further comprising means for detecting a rate of change of the portion of the steering member; said attitude control means further calculating in advance a correction value corresponding to said rate of change.

4. Attitude control system for antenna on mobile body for maintaining it in opposing relationship with a stationary object comprising:

a first drive mechanism for driving an antenna for rotation about a horizontal axis on the mobile body;

first energizing means responsive to first attitude information for energizing the first drive mechanism to establish an angle of rotation which is specified by the first attitude information;

a second drive mechanism for driving the antenna for rotation about a vertical axis on the mobile body;

second energizing means responsive to second attitude information for energizing the second drive mechanism to establish an angle of rotation of the antenna which is specified by the second attitude information;

means for detecting the distance travelled by the mobile body;

means for detecting an attitude of the mobile body;

rate of change detecting means for detecting a rate of change of speed of the mobile; and attitude control means for supplying the first and the second attitude information to the first and the second energizing means, respectively, for correcting the first and the second attitude information dependent on the distance travelled and the attitude for maintaining the attitude of the antenna in opposing relationship with the stationary object, and for updating the first and the second attitude information which is supplied to the energizing means;

said attitude control means, at a value exceeding a predetermined value of the rate of change, calculating and accumulating in advance a correction value corresponding to the rate of change and updating the first attitude information for predictive correction of the attitude of the antenna; and said attitude control means, at a value not exceeding the predetermined value, updating the first attitude information by cancelling the accumulated in advance correction value from the first attitude information.

5. Attitude control system as set forth in claim 4 further comprising means for detecting the speed of the mobile body and means for detecting the position of a steering member of the mobile body; said attitude control means calculating in advance a correction value corresponding to the position of the steering member and the speed of the mobile body and updating the second attitude information for predictive correction of the attitude of the antenna.

6. Attitude control system for antenna on mobile body for maintaining it in opposing relationship with a stationary object comprising:

a first drive mechanism for driving an antenna for rotation about a horizontal axis on the mobile body;

first energizing means responsive to first attitude information for energizing the first drive mechanism to establish an angle of rotation of the antenna which is specified by the first attitude information;

a second drive mechanism for driving the antenna for rotation about a vertical axis on the mobile body;

second energizing means responsive to second attitude information for energizing the second drive mechanism to establish an angle of rotation of the antenna which is specified by the second attitude information;

means for detecting the distance travelled by the mobile body;

means for detecting an attitude of the mobile body;

rate of change detecting means for detecting a rate of change of throttle opening of a throttle valve of an engine on the mobile body; and attitude control means for supplying the first and the second attitude information to the first and the second energizing means, respectively, for correcting the first and the second attitude information dependent on the distance traveled and the attitude for maintaining the attitude of the antenna in opposing relationship with the stationary object, and for updating the first and the second attitude information which is supplied to the energizing means;

said attitude control means, at a value exceeding a predetermined value of the rate of change, calculating and accumulating in advance a correction value corresponding to the rate of change and updating the first attitude information for predictive correction of the attitude of the antenna; and said attitude control means, at a value not exceeding the predetermined value, updating the first attitude information by cancelling the accumulated in advance correction value from the first attitude information.

7. Attitude control system as set forth in claim 6 further comprising menas for detecting the speed of the mobile body and means for detecting the position of a steering member of the mobile body; said attitude control means calculating in advance a correction value corresponding to the position of the steering member and the speed of the mobile body and updating the second attitude information for predictive correction of the attitude of the antenna.

8. Attitude control system for antenna on mobile body for maintaining it in opposing relationship with a stationary object comprising:

a first drive mechanism for driving an antenna for rotation about a horizontal axis on the mobile body;

first energizing means responsive to first attitude information for energizing the first drive mechanism to establish an angle of rotation of the antenna which is specified by the first attitude information;

a second drive mechanism for driving the antenna for rotation about a vertical axis on the mobile body;

second energizing means responsive to second attitude information for energizing the second drive mechanism to establish an angle of rotation of the antenna which is specified by the second attitude information;

means for detecting the distance travelled by the mobile body;

means for detecting an attitude of the mobile body;

rate of change detecting means for detecting a rate of change of position of a braking member of the mobile; and attitude control means for supplying the first and the second attitude information to the first and the second energizing means, respectively, for correcting the first and the second attitude information dependent on the distance travelled and the attitude for maintaining the attitude of the antenna in opposing relationship with the stationary object, and for updating the first and the second attitude information which is supplied to the energizing means;

said attitude control means, at a value exceeding a predetermined value of the rate of change calculating and accumulating in advance a correction value corresponding to the rate of change and updating the first attitude information for predictive correction of the attitude of the antenna; and said attitude control means, at a value not exceeding the predetermined value, updating the first attitude information by cancelling the accumulated in advance correction value for the first attitude information.

9. Attitude control system as set forth in claim 8 further comprising means for detecting the speed of the mobile body and means for detecting the position of a steering member of the mobile body; said attitude control means calculating in advance a correction value corresponding to the position of the steering member and the speed of the mobile body and updating the second attitude information for predictive correction of the attitude of the antenna.

10. Attitude control system for antenna on mobile body for maintaining it in opposing relationship with a stationary object comprising:

a first drive mechanism for driving an antenna for rotation about a horizontal axis on the mobile body;

first energizing means responsive to first attitude information for energizing the first drive mechanism to establish an angle of rotation of the antenna which is specified by the first attitude information;

a second drive mechanism for driving the antenna for rotation about a vertical axis on the mobile body;

second energizing means responsive to second attitude information for energizing the second drive mechanism to establish an angle of rotation of the antenna whichis specified by the second attitude information;

means for detecting the distance travelled by the mobile body;

means for detecting an attitude of the mobile body;

first detecting means for detecting a rate of change of throttle opening of a throttle valve of an engine on the mobile;

second detecting means for detecting a rate of change of position of a braking member of the mobile; and attitude control means for supplying the first and the second attitude information to the first and the second energizing means, respectively, for correcting the first and the second attitude information dependent on the distance travelled and the attitude for maintaining the attitude of the antenna in opposing relationship with the stationary object, and for updating the first and the second attitude information which is supplied to the energizing means;

said attitude control means, at a value exceeding a predetermined value of the rate of change of the throttle opening, calculating and accumulating in advance a correction value corresponding to the rate of change of the throttle opening and updating the first attitude information for predictive correction of the attitude of the antenna; and said attitude control means at a value of the rate of change of the throttle opening not exceeding the predetermined value, up dating the first attitude information by cancelling the accumulated in advance correction value from the first attitude information;

said attitude control means, at a value exceeding a predetermined value of the rate of change of the position of the braking member, calculating and accumulating in advance a correction value corresponding to the rate of change of the position of the braking member and updating the first attitude information for predictive correction of the attitude of the antenna; and said attitude control means, at a value of the rate of change of the position not exceeding the predetermined value, updating the first attitude information by cancelling the accumulated in advance correction value from the first attitude information.

11. Attitude control system as set forth in claim 10 further comprising means for detecting the speed of the mobile body and means for detecting the position of a steering member of the mobile body; said attitude control means calculating in advance a correction value corresponding to the position of the steering member and the speed of the mobile body and updating the second attitude information for predictive correction of the attitude of the antenna.

* * * * *